US008360940B2

(12) United States Patent
Kole et al.

(10) Patent No.: US 8,360,940 B2
(45) Date of Patent: Jan. 29, 2013

(54) LOWER LEG AND FOOT EXERCISE DEVICE

(75) Inventors: Ryan Michael Kole, Chicago, IL (US); Naftali Mayer Garber, Chicago, IL (US)

(73) Assignee: RK Inventions, LLC, Chicago, IL (US)

( * ) Notice: Subject to any disclaimer, the term of this patent is extended or adjusted under 35 U.S.C. 154(b) by 205 days.

(21) Appl. No.: 12/947,593

(22) Filed: Nov. 16, 2010

(65) Prior Publication Data

US 2011/0124473 A1 May 26, 2011

Related U.S. Application Data

(60) Provisional application No. 61/262,043, filed on Nov. 17, 2009.

(51) Int. Cl.
*A63B 22/16* (2006.01)

(52) U.S. Cl. ..... 482/121; 482/79; 482/148

(58) Field of Classification Search ..... 482/121–129, 482/79–80, 148, 92, 137
See application file for complete search history.

(56) References Cited

U.S. PATENT DOCUMENTS

| | | | |
|---|---|---|---|
| 478,166 | A | 7/1892 | Madsen |
| 1,345,096 | A | 6/1920 | Mount |
| 1,509,793 | A | 9/1924 | Thompson |
| 1,587,749 | A | 6/1926 | Bierly |
| 1,671,096 | A | 5/1928 | Anderson |
| 1,911,390 | A | 5/1933 | Pullman |
| 1,978,244 | A | 10/1934 | Bach |
| 1,989,899 | A | 2/1935 | Vance |
| 2,022,883 | A | 12/1935 | Gee |
| 2,230,890 | A | 2/1941 | McClenathen |
| 2,250,493 | A | 7/1941 | Milne |
| 2,374,730 | A | 5/1945 | Catlin |
| 3,088,458 | A | 5/1963 | Stewart |
| 3,295,847 | A | 1/1967 | Matt, Sr. |
| 3,297,320 | A | 1/1967 | Benedetto |
| 3,472,508 | A | 10/1969 | Baker et al. |
| 3,625,203 | A | 12/1971 | Wadelton |
| 3,636,946 | A | 1/1972 | Hardy |
| 3,741,540 | A | 6/1973 | Shimizu |
| 3,863,916 | A | 2/1975 | Cline |

(Continued)

FOREIGN PATENT DOCUMENTS

| | | |
|---|---|---|
| DE | 202004003720 | 6/2004 |
| EP | 1752196 | 2/2007 |

(Continued)

OTHER PUBLICATIONS

European Patent Office, International Search Report, Written Opinion of the International Searching Authority for PCT/GB2009/002049 mailed Dec. 17, 2009.

(Continued)

*Primary Examiner* — Stephen Crow
(74) *Attorney, Agent, or Firm* — Klintworth & Rozenblat IP LLC

(57) ABSTRACT

An exercise device for a lower leg and foot is provided. The exercise device provides a user with the ability to exercise multiple muscles in both lower legs and both feet, and provides the user with multiple exercises with a single exercise device. Additionally, the exercise device is capable of providing variable resistances during exercise to accommodate users of different strength and to accommodate a user's increase in strength. To provide variable resistance, the exercise device includes a plurality of resilient resistance member interchangeably coupled to a housing of the exercise device.

10 Claims, 12 Drawing Sheets

U.S. PATENT DOCUMENTS

| | | | | |
|---|---|---|---|---|
| 3,917,261 | A | 11/1975 | Small et al. | |
| D251,313 | S | 3/1979 | Jinotti | |
| 4,159,111 | A | 6/1979 | Lowth | |
| 4,279,415 | A | 7/1981 | Katz | |
| 4,371,160 | A | 2/1983 | Shooltz | |
| 4,461,472 | A | 7/1984 | Martinez | |
| 4,501,421 | A | 2/1985 | Kane et al. | |
| D281,343 | S | 11/1985 | Krive | |
| 4,577,861 | A | 3/1986 | Bangerter et al. | |
| 4,623,141 | A | 11/1986 | Salvino | |
| 4,733,859 | A | 3/1988 | Kock et al. | |
| 4,739,986 | A | 4/1988 | Kucharik et al. | |
| 4,870,761 | A | 10/1989 | Tracy | |
| 5,005,560 | A | 4/1991 | Quam et al. | |
| 5,035,421 | A | 7/1991 | Scheller | |
| 5,039,093 | A | 8/1991 | Collier | |
| 5,087,036 | A | 2/1992 | Cooper | |
| D325,968 | S | 5/1992 | Nofsinger | |
| 5,127,892 | A | 7/1992 | Sawdon | |
| 5,142,797 | A | 9/1992 | Cole, III | |
| 5,176,598 | A | 1/1993 | Gardner | |
| 5,256,118 | A | 10/1993 | Chen | |
| 5,267,923 | A | 12/1993 | Piaget et al. | |
| 5,267,924 | A | 12/1993 | Miller et al. | |
| 5,304,106 | A | 4/1994 | Gresko | |
| 5,368,535 | A | 11/1994 | Twardokens | |
| 5,368,536 | A | 11/1994 | Stodgell | |
| 5,413,543 | A | 5/1995 | Drago | |
| 5,433,684 | A | 7/1995 | Carrillo | |
| 5,536,226 | A | 7/1996 | Gordon | |
| 5,643,148 | A | 7/1997 | Naville | |
| 5,645,516 | A | 7/1997 | Foster | |
| D383,813 | S | 9/1997 | Zoller | |
| 5,702,354 | A | 12/1997 | DeSpain et al. | |
| 5,732,481 | A | 3/1998 | Farhad | |
| D397,746 | S | 9/1998 | Drach et al. | |
| 5,802,743 | A | 9/1998 | Chien | |
| 5,851,166 | A | 12/1998 | Bernardson | |
| 5,891,002 | A | 4/1999 | Maki | |
| 5,897,464 | A | 4/1999 | Mcleod | |
| 5,984,841 | A | 11/1999 | John | |
| 6,042,520 | A | 3/2000 | Cantero | |
| 6,063,010 | A | 5/2000 | Howd et al. | |
| 6,063,013 | A | 5/2000 | Vathappallil | |
| 6,105,283 | A | 8/2000 | Park | |
| 6,419,611 | B1 | 7/2002 | Levine et al. | |
| 6,572,514 | B1 | 6/2003 | Calafato | |
| 6,821,235 | B1 * | 11/2004 | Johnson et al. | 482/79 |
| 6,942,604 | B2 * | 9/2005 | Teff | 482/79 |
| 7,300,026 | B2 * | 11/2007 | Pap | 248/118 |
| 7,364,534 | B2 | 4/2008 | Zoller et al. | |
| D596,246 | S * | 7/2009 | Nofsinger | D21/685 |
| 7,614,978 | B2 | 11/2009 | Piaget et al. | |
| D622,789 | S * | 8/2010 | Gillis | D21/685 |
| 7,771,327 | B1 | 8/2010 | Reams | |
| 7,794,368 | B2 | 9/2010 | Ruthorford | |
| 2002/0165069 | A1 | 11/2002 | Ravikumar et al. | |
| 2004/0009850 | A1 | 1/2004 | Teff | |
| 2004/0194348 | A1 | 10/2004 | Campbell et al. | |
| 2006/0168785 | A1 | 8/2006 | Kraft et al. | |
| 2007/0294922 | A1 | 12/2007 | Ma et al. | |
| 2008/0113854 | A1 | 5/2008 | Ferri | |
| 2011/0224049 | A1 | 9/2011 | Farrell | |

FOREIGN PATENT DOCUMENTS

| | | |
|---|---|---|
| GB | 5187 | 0/1909 |
| WO | 9702765 | 1/1997 |
| WO | 2008107687 | 9/2008 |
| WO | 2010040974 | 4/2010 |

OTHER PUBLICATIONS

United Kingdom Search Report for GB0820331.7 dated Mar. 17, 2009.

Email sent by Mr. Steve Nipper (steve@bnip.com) on Nov. 26, 2012 at 2:23PM identifying the references included on this IDS.

* cited by examiner

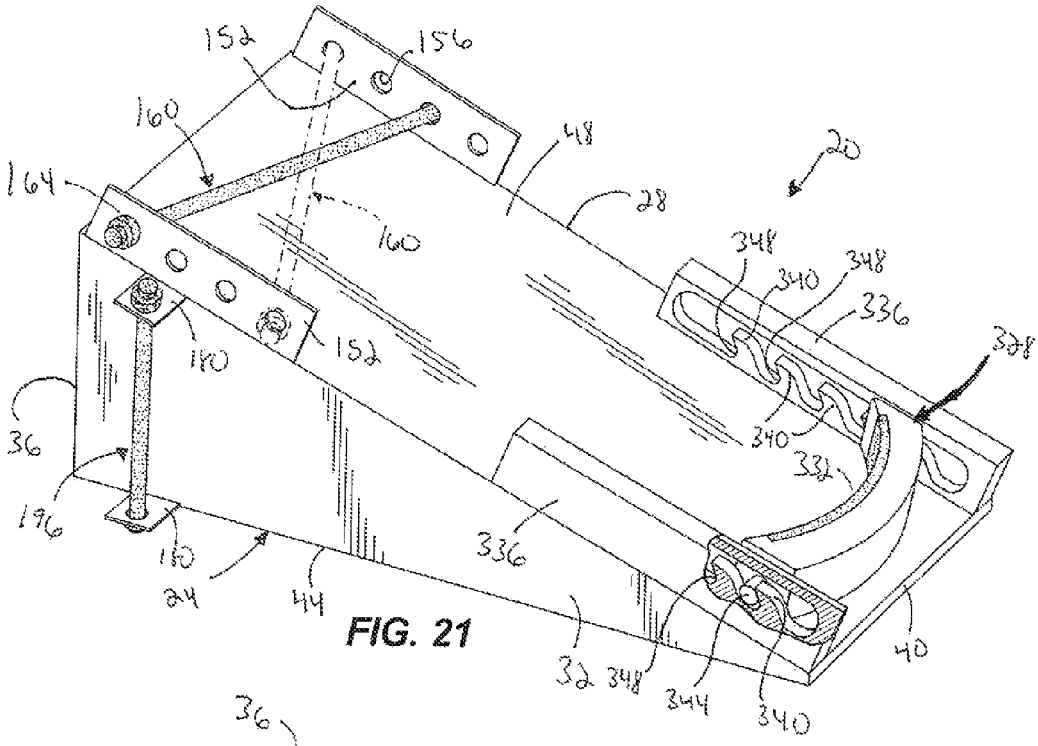

FIG. 21

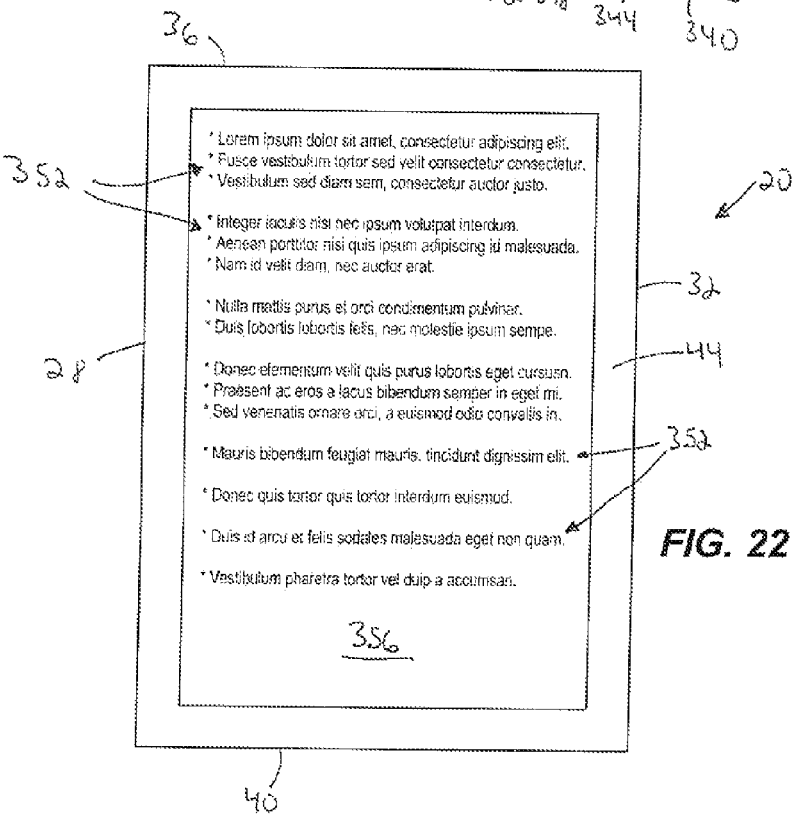

* Lorem ipsum dolor sit amet, consectetur adipiscing elit.
* Fusce vestibulum tortor sed velit consectetur consectetur.
* Vestibulum sed diam sem, consectetur auctor justo.

* Integer iaculis nisi nec ipsum volutpat interdum.
* Aenean porttitor nisi quis ipsum adipiscing id malesuada.
* Nam id velit diam, nec auctor erat.

* Nulla mattis purus et orci condimentum pulvinar.
* Duis lobortis lobortis felis, nec molestie ipsum sempe.

* Donec elementum velit quis purus lobortis eget cursusn.
* Praesent ac eros a lacus bibendum semper in egel mi.
* Sed venenatis ornare arcu, a euismod odio convallis in.

* Mauris bibendum feugiat mauris, tincidunt dignissim elit.

* Donec quis tortor quis tortor interdum euismod.

* Duis ut arcu et felis sodales malesuada eget non quam.

* Vestibulum pharetra tortor vel duip a accumsan.

FIG. 22

LOWER LEG AND FOOT EXERCISE DEVICE

RELATED APPLICATIONS

The present application claims the benefit of U.S. Provisional Patent Application No. 61/262,043, filed Nov. 17, 2009, the entire contents of which are incorporated herein by reference.

FIELD OF THE INVENTION

The present invention generally relates to an exercise device and, more particularly, to a lower leg and foot exercise device.

BACKGROUND

Numerous exercise devices exist in the marketplace. However, many of these exercise devices are extremely expensive, thereby making it difficult for average consumers to afford and purchase such exercise devices. In addition, such exercises devices are typically specialized exercise equipment for working isolated or individual muscles. Thus, such exercise equipment only provides a single exercise for a user to exercise a single muscle. Further, exercise devices for working a lower leg or foot of an individual and, particularly, toes and an arch of an individual, are typically unsophisticated. Further yet, people usually neglect foot muscles when exercising and, therefore, exercise devices do not focus on foot muscles.

SUMMARY

In one example, an exercise device is provided and is capable of exercising intrinsic and extrinsic muscles of a foot such as, for example, toes, metatarsal arch, calf, shins, etc. The exercise device is capable of exercising both right and left feet of a user.

In another example, a method of exercising is provided and includes exercising intrinsic and extrinsic muscles of a foot such as, for example, toes, metatarsal arch, calf, shins, etc. The method also includes exercising both right and left feet of a user.

In yet another example, an exercise device for a foot is provided and includes a housing including a top wall and a side wall, a top connecting member, a first resilient resistance member engageable with the top connecting member to removably couple the first resilient resistance member to the top wall, wherein the first resilient resistance member is adapted to be engaged by the foot, a second resilient resistance member engageable with the top connecting member to removably couple the second resilient resistance member to the top wall, wherein the second resilient resistance member is adapted to be engaged by the foot, and wherein only one of the first resilient resistance member and second resilient resistance member engages the top connecting member at a time to removably couple only one of the first resilient resistance member and second resilient resistance member to the top wall at a time, a side connecting member, a third resilient resistance member engageable with the side connecting member to removably couple the third resilient resistance member to the side wall, wherein the third resilient resistance member is adapted to be engaged by the foot, and a fourth resilient resistance member engageable with the side connecting member to removably couple the fourth resilient resistance member to the side wall, wherein the fourth resilient resistance member is adapted to be engaged by the foot, and wherein only one of the third resilient resistance member and fourth resilient resistance member engages the side connecting member at a time to removably couple only one of the third resilient resistance member and fourth resilient resistance member to the top wall at a time.

In still another example, an exercise device for a foot is provided and includes a housing and a plurality of resilient resistance members interchangeably couplable to the housing to provide a user with variable resistance. The resilient resistance members may be hollow tubes. The resilient resistance members may each be unitarily formed as one-piece and solid throughout. The resilient resistance members may include enlarged portions near their ends. The resilient resistance members may be coupled to the housing in a plurality of orientations.

BRIEF DESCRIPTION OF THE DRAWINGS

FIG. 21 is a top rear perspective view of a further exemplary embodiment of an exercise device, this exercise device includes an adjustable heel support; and FIG. 22 is a bottom view of still a further exemplary embodiment of an exercise device, this exercise device is shown with information thereon.

Figure 1:
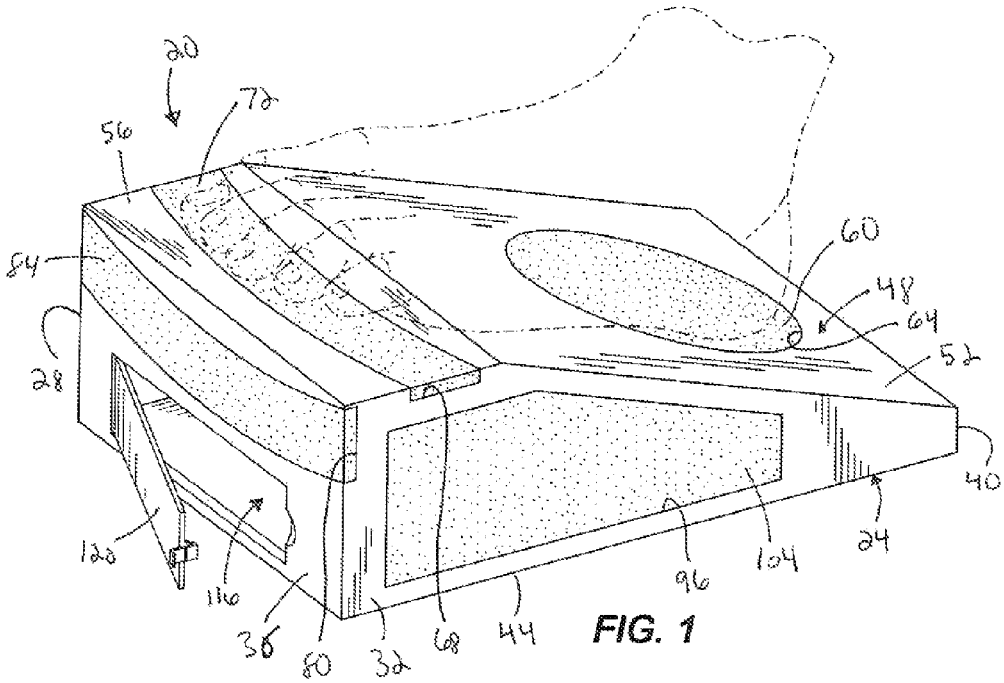
FIG. 1 is a top front perspective view of an exemplary exercise device.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION

Figure 2:
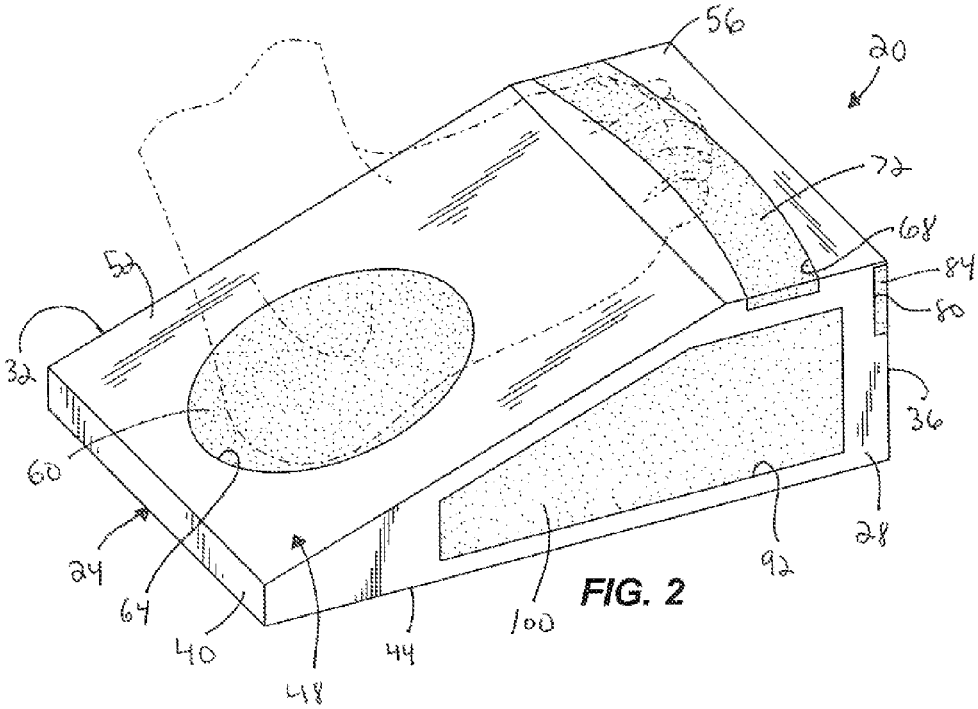
FIG. 2 is a top rear perspective view of the exercise device shown in FIG. 1.
Figure 3:
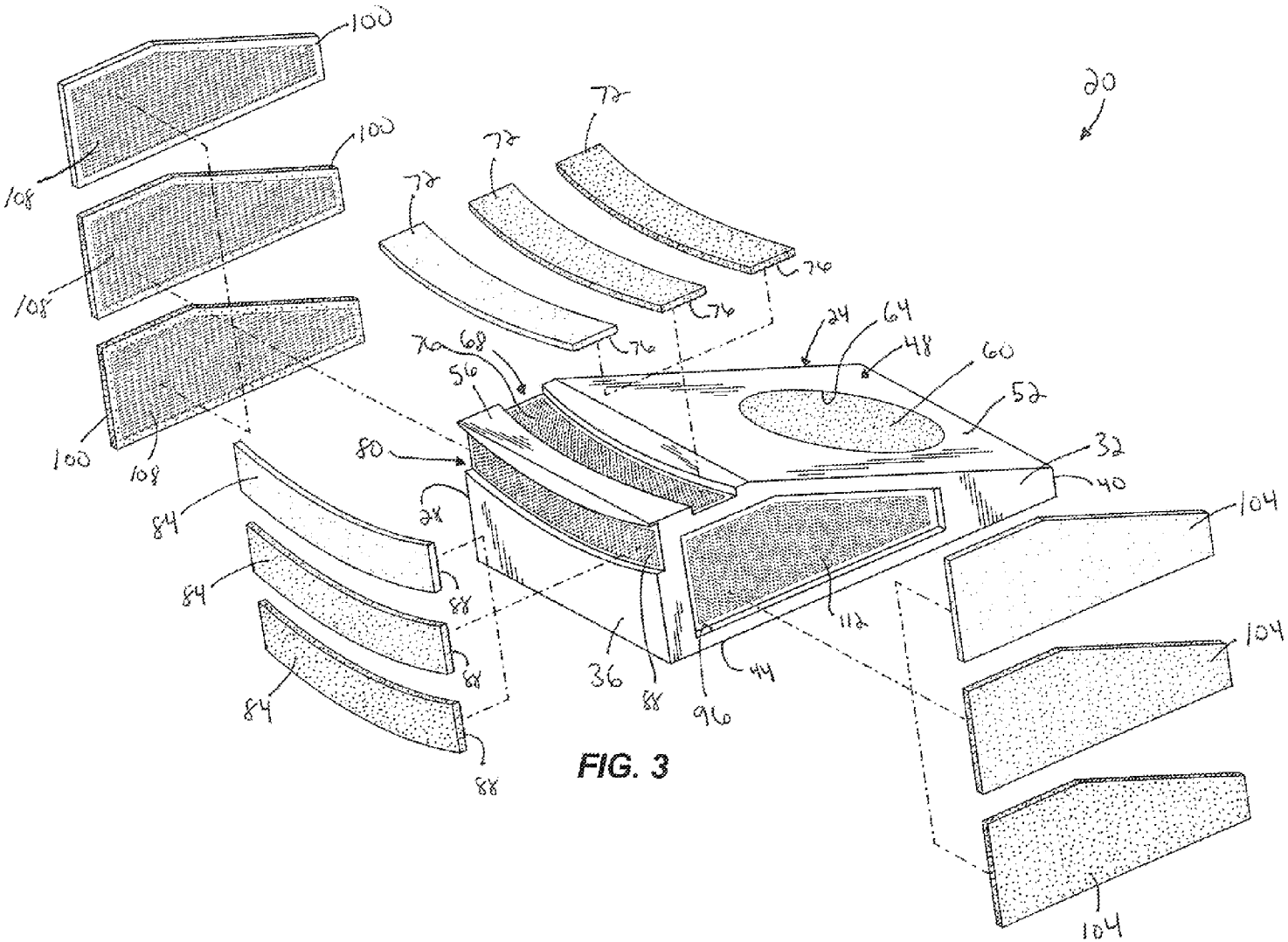
FIG. 3 is an exploded top front perspective view of the exercise device shown in FIG. 1, the exercise device is shown with a plurality of interchangeable resistance members.

With reference to FIGS. 1-3, an exemplary exercise device 20 is illustrated. The illustrated exemplary exercise device 20 is adapted to exercise numerous portions of both a right and left lower leg and both right and left feet of a user. For example, depending on how a user utilizes the exercise device 20, a user may exercise their right and left calf, right and left arch, all toes on right and left feet, right and left shins, or various other muscles in a user's right and left lower legs and right and left feet. The user may also use the exercise device 20 to exercise both lower legs simultaneously or one lower leg at a time. In addition, a user may perform exercises on the exercise device 20 either standing up or sitting down. At least some of the operations of and exercises with this exemplary exercise device 20 and other exemplary exercise devices 20 illustrated and described herein will be described in greater detail below.

With continued reference to FIGS. 1-3, the illustrated exemplary embodiment of the exercise device 20 includes a housing 24 having a right wall 28, a left wall 32, a front wall 36, a rear wall 40, a bottom wall 44, and a top wall 48. The housing 24 is capable of being manufactured in a wide variety of configurations. In some exemplary embodiments, the housing 24 may be hollow to reduce weight. In other exemplary embodiments, the housing 24 may be solid to provide more rigidity and more weight to help the exercise device 20 remain in place during use and increase the life of the exercise device 20. In yet other exemplary embodiments, the housing may not include a bottom wall and the housing may be hollow. In addition, the housing 24 is capable of being made with a wide variety of materials such as, for example, plastic, plastic gel, nylon reinforced plastic, microcellular rubber, ethyl vinyl acetate, polyurethane, acrylonitrile butadiene styrene (ABS), metal, wood, or any other material. In the illustrated exemplary embodiment, the right wall 28, left wall 32, front wall 36, and rear wall 40 are vertical, the bottom wall 44 is horizontal and is positionable on a support surface such as a floor or ground surface, and the top wall 48 includes an angled portion 52 and a horizontal portion 56. The angled portion 52 may be oriented at a variety of different angles and be within the intended spirit and scope of the present invention. Some exemplary angles include, but are not limited to, ten degrees, fifteen degrees, twenty degrees, twenty-five degrees, thirty degrees, forty-five degrees, or any other lesser, greater or in-between degree. Alternatively, the entire top wall 48 may be horizontal. In some embodiments, the housing 24 may include one or more friction members on the bottom wall 44 to inhibit the exercise device 20 from sliding on a ground or floor surface during use. The one or more friction members may be in the form of cylindrical or semi-spherical projections coupled at four corners of the bottom wall 44. Other friction members may include strips of material along edges of the bottom wall 44. The friction members may be made of a variety of different materials as long as the materials provide a desired level of friction to inhibit sliding of the exercise device 20 to a desired extent. Exemplary materials may include, but are not limited to, rubber, foam, soft plastic, adhesive coated materials, etc.

A heel support 60 is coupled to the angled portion 52 of the top wall 48. The heel support 60 provides support to a user's heel and inhibits undesired slippage of the user's heel during use. In the illustrated exemplary embodiment, the heel support 60 is generally oval in shape and is positioned in a heel cavity 64 defined in the top wall 48 in order to be flush with the top wall 48 of the exercise device 20. Alternatively, the heel support 60 may be other shapes such as, for example, round, square, rectangular, triangular, or any other polygonal or arcuately perimetered shape, and the heel support 60 may be coupled to the top wall 48 in an elevated manner above or in a recessed manner below the top wall 48. The heel support 60 may be made of a variety of different materials, but preferably is made of a material that provides an appropriate level of friction to inhibit slipping of a user's heel. For example, the heel support 60 may be made of materials such as rubber, plastic, etc. It should be understood that the exercise device 20 may be coated by or covered with a material having non-slipping or friction characteristics. Any portion of the exercise device 20 may be coated by or covered with such material including, for example, the entire top wall 48, the entire housing 24, the angled portion 52 of the top wall 48, or any other portion of the housing 24. It should also be understood that the top wall 48 of the exercise device 20 may have a plurality of heel supports thereon and such plurality of heel supports may be any size. For example, an array of smaller heel supports may be spaced apart and spread over the top wall 48.

A top recess 68 is defined in the horizontal portion 56 of the top wall 48 and a top resistance member 72 is removably positionable in the top recess 68 and removably couplable to the housing 24 in the top recess 68. The top resistance member 72 is removably coupled to the housing 24 with a connecting member 76. In the illustrated exemplary embodiment, the top resistance member 72 is removably coupled to the housing 24 with a hook and loop type fastener 76 (see FIG. 3). One of the hook portion and the loop portion is coupled to the top resistance member 72 and the other of the hook portion and loop portion is positioned in the top recess 68 and coupled to a bottom surface of the top recess 68. Alternatively, the top resistance member 72 may be removably coupled to the housing 24 in the top recess 68 in a variety of other manners such as, for example: one or more snaps; interference or friction fit; adhesive; removable fasteners such as screws, wing-nuts, bolt and nut combination; or any other manner of removably connecting the top resistance member 72 to the housing 24.

In the illustrated exemplary embodiment, the top recess 68 and the top resistance member 72 are complementarily configured to position a top surface of the top resistance member 72 flush with the horizontal portion of the top wall 48. In other exemplary embodiments, the top recess 68 and the top resistance member 72 may be configured to position the top surface of the top resistance member 72 elevated above or recessed below the top wall 48 of the exercise device 20.

The top resistance member 72 is made of resilient material that allows the top resistance member 72 to compress upon exertion of a force thereupon by a portion of a user's foot and return or substantially return to its state prior to exertion of the force thereupon. In some exemplary embodiments, the top resistance member 72 may be made of rubber. In other exemplary embodiments, the top resistance member 72 may be made of plastic. In further embodiments, the top resistance member 72 may be made of foam, latex, sand, water, gel, one or more springs, or micro beads, or any other material and the top recess 68 may be configured to retain such materials.

In the illustrated exemplary embodiment, the top resistance member 72 is arcuate in shape in order to accommodate toes of varying lengths on both the right and left feet of a user. For example, with reference to FIG. 1, a user's left foot is shown in phantom lines and, as can be seen, toes commonly have different lengths relative to one another with the big toe oftentimes being the longest and the toes decreasing in length as they progress toward the little toe. If the user places his/her left foot on the exercise device 20 as illustrated, the user places the big toe at or near a peak of the arcuate top resistance member 72 and the other toes are positioned along the arcuate top resistance member 72 as they approach the left wall 32 of the exercise device 20. Conversely, as shown in FIG. 2, a user places his/her right foot on the exercise device 20 (shown in phantom) and places the big toe at or near a peak of the arcuate top resistance member 72 and the other toes are positioned along the arcuate top resistance member 72 as they approach the right wall 28 of the exercise device 20. Thus, the arcuate top resistance member 72 is capable of accommodating toes of varying lengths on both right and left feet. In alternative exemplary embodiments, the top resistance member 72 may have other shapes such as, for example, linear or straight, "V" shaped with the peak of the "V" closer to the front wall 36, or any other shape.

With particular reference to FIGS. 1 and 3, a front recess 80 is defined in the front wall 36 of the exercise device 20 and a front resistance member 84 is removably positionable in the front recess 80 and removably couplable to the housing 24 in the front recess 80. The front resistance member 84 may be removably coupled to the housing 24 with a front connecting member 88. In the illustrated exemplary embodiment, the front resistance member 84 is removably coupled to the housing 24 with a hook and loop type fastener 88 (see FIG. 3). One of the hook portion and the loop portion is coupled to the front resistance member 84 and the other of the hook portion and loop portion is positioned in and coupled to a rear surface of the front recess 80. Alternatively, the front resistance member 84 may be removably coupled to the housing 24 in the front recess 80 in a variety of other manners such as, for example: one or more snaps; interference or friction fit; adhesive; removable fasteners such as screws, wing-nuts, bolt and nut combination; or any other manner of removably connecting the front resistance member 84 to the housing 24.

In the illustrated exemplary embodiment, the front recess 80 and the front resistance member 84 are complementarily configured to position a front surface of the front resistance member 84 flush with the front wall 36. In other exemplary embodiments, the front recess 80 and the front resistance member 84 may be configured to position the front surface of the front resistance member 84 projecting from or recessed within the front wall 36 of the exercise device 20.

The front resistance member 84 is made of resilient material that allows the front resistance member 84 to compress upon exertion of a force thereupon by a portion of a user's foot and return or substantially return to its state prior to exertion of the force thereupon. The front resistance member 84 is capable of being made of all the same materials as the top resistance member 72 and, therefore, will not be presented again herein.

In the illustrated exemplary embodiment, the front resistance member 84 is arcuate in shape in order to accommodate toes of varying lengths on both the right and left feet of a user. In other exemplary embodiments, the front resistance member may be straight. A user's foot commonly has toes of different lengths relative to one another with the big toe oftentimes being the longest and the toes decreasing in length as they progress toward the little toe. If the user places his/her left foot on the exercise device 20 with his/her toes extending over a front edge of the top wall 48 and curling his/her toes down into contact with the front resistance member 84, the user places the big toe at or near a peak of the arcuate front resistance member 84 and the other toes are positioned along the arcuate front resistance member 84 as they approach the left wall 32 of the exercise device 20. Conversely, if the user places his/her right foot on the exercise device 20 with his/her toes extending over the front edge of the top wall 48 and curling his/her toes down into contact with the front resistance member 84, the user places the big toe at or near a peak of the arcuate front resistance member 84 and the other toes are positioned along the arcuate front resistance member 84 as they approach the right wall 28 of the exercise device 20. Thus, the arcuate front resistance member 84 is capable of accommodating toes of varying lengths on both right and left feet. In alternative exemplary embodiments, the front resistance member 84 may have other shapes such as, for example, linear, "V" shaped with the peak of the "V" pointing toward the bottom wall 44, or any other shape.

Referring again to FIGS. 1-3, right and left side recesses 92, 96 are respectively defined in the right and left walls 28, 32 of the exercise device 20. A right resistance member 100 is removably positionable in the right recess 92 and removably couplable to the housing 24 in the right recess 92, and a left resistance member 104 is removably positionable in the left recess 96 and removably couplable to the housing 24 in the left recess 96. The right and left resistance members 100, 104 may be removably coupled to the housing 24 respectively with right and left connecting members 108, 112. In the illustrated exemplary embodiment, the right and left resistance members 100, 104 are removably coupled to the housing 24 with right and left hook and loop type fasteners 108, 112 (see FIG. 3). One of the hook portion and the loop portion is coupled to each of the right and left resistance members 100, 104 and the other of the hook portion and loop portion is positioned in and coupled to an interior surface of each of the right and left recesses 92, 96. Alternatively, the right and left resistance members 100, 104 may be removably coupled to the housing 24 in the right and left recesses 92, 96 in a variety of other manners such as, for example: one or more snaps; interference or friction fit; adhesive; removable fasteners such as screws, wing-nuts, bolt and nut combination; or any other manner of removably connecting the right and left resistance members to the housing 24.

In the illustrated exemplary embodiment, the right and left recesses 92, 96 and the right and left resistance members 100, 104 are respectively complementarily configured to position outer surfaces of the right and left resistance members 100, 104 flush with their respective right and left side walls 28, 32. In other exemplary embodiments, the right and left recesses 92, 96 and the right and left resistance members 100, 104 may be configured to position the outer surfaces of the right and left resistance members 100, 104 projecting from or recessed within the right and left side walls 28, 32 of the exercise device 20.

The right and left resistance members 100, 104 are made of resilient material that allows the right and left resistance members 100, 104 to compress upon exertion of a force thereupon by a portion of a user's foot and return or substantially return to their state prior to exertion of the force thereupon. The right and left resistance members 100, 104 are capable of being made of all the same materials as the top resistance member 72 and, therefore, will not be presented again herein.

In the illustrated exemplary embodiment, the right and left resistance members 100, 104 have a shape similar to shapes of the right and left side walls 28, 32. These exemplary shapes of the right and left resistance members 100, 104 do not necessarily have to be similar to the shapes of the right and left side walls 28, 32. Thus, these exemplary shapes of the right and left resistance members 100, 104 are not intended to be limiting, and the right and left resistance members 100, 104 are capable of having other shapes and being within the spirit and scope of the present invention.

Referring now to FIG. 3, an exploded view of the exemplary exercise device 20 is illustrated to exemplify the exercise device's ability to provide varying resistance to a user when exercising his/her feet. In this illustrated exemplary embodiment, varying resistance is provided by using multiple interchangeable resistance members. Variable resistance may be provided in different manners and still be within the intended spirit and scope of the present invention. For exemplary purposes, the exercise device 20 is shown to include three of each of the top, front, right, and left resistance members 72, 84, 100, 104. The exemplary illustration of three resistance members is not intended to be limiting and any number of resistance members may be used to provide varying degrees of resistance adjustability. The various resistance members may be identified in a particular manner that assists a user with identifying a desired resistance member. For example, the various resistance members may be color-coded, marked with unique indicia, marked with a unique pattern, or any other manner of assigning uniqueness to each resistance member so a user can easily identify desired resistance members.

With continued reference to FIG. 3, a plurality of top resistance members 72 are illustrated and each of the plurality of top resistance members 72 provide a different amount of resistance, which is aesthetically represented in FIG. 3 by the different shading methods. The varying amounts of resistance may be provided in a variety of different manners. For example, the plurality of top resistance members 72 may be made out of different materials or may be made of a similar material. In instances where the top resistance members 72 are made of the same material, the top resistance members 72 may have varying densities or rigidities. No matter the manner used to achieve varying resistances, a user inserts and couples the desired top resistance member 72 into the top recess 68 for use during exercise.

The preceding remarks relating to the top resistance member 72 and achieving varying levels or resistance also apply to the front, right, and left resistance members 84, 100, 104 and, therefore, will not be repeated herein.

Referring back to FIG. 1, a cavity 116 is defined in the housing 24 and a door 120 is coupled to the housing 24 to selectively close off the cavity 116 from a front of the exercise device 20. A user may place any unused resistance members or other desired equipment into the cavity 116 and seal the cavity 116 with the door 120. This feature will allow a user to keep all of the resistance members and necessary equipment for the exercise device 20 in one place with the exercise device 20, thereby decreasing the chance that resistance members or other equipment are lost, misplaced, or otherwise unavailable when a user requires them for use with the exercise device 20. In the illustrated exemplary embodiment, the cavity 116 is accessible from a front of the exercise device 20 and, appropriately, the door 120 is hingedly coupled to the front wall 36 to close off the cavity 116 from the front. Alternatively, the cavity 116 may be defined in the housing 24 in other manners that would provide accessibility thereto on other sides of the housing 24 including, but not limited to, the bottom wall 44, the rear wall 40, the top wall 48, the right wall 28, and the left wall 32. Appropriately, the door 120 could be hingedly coupled to the other walls to seal off the cavity 116 from those sides. Additionally, the door 120 may be coupled to any of the walls in a variety of manners other than by a hinge. For example, the door 120 may be slidable between open and closed positions.

It should be understood that any of the exemplary embodiments of exercise devices 20 disclosed herein may include a cavity 116 and door 120 as described above and illustrated in FIG. 1.

Now that the structure of the exercise device 20 illustrated in FIGS. 1-3 has been described, exemplary operations and exercises of the exercise device 20 will be described herein. These exemplary operations and exercises are not intended to be limiting. Rather, the exercise device 20 is capable of performing other operations and exercises and any such operations and exercises are intended to be within the spirit and scope of the present invention.

As indicated above, a user may exercise either his/her left foot (see FIG. 1) or his/her right foot (see FIG. 2). With reference to FIGS. 1 and 2, a user may position his/her heel on the heel support 60 and his/her toes on the top resistance member 72 and properly align his/her toes with the arcuate top resistance member 72 so that all the user's toes on positioned on top of the top resistance member 72. Then, the user pushes downward against the top resistance member 72 with his/her toes and releases his/her toes. This is repeated as desired by the user. If the user desires to replace the top resistance member 72 with another top resistance member 72 to alter the resistance level, the user pulls the top resistance member 72 up from the top wall 48 of the exercise device 20, thereby releasing the top connecting member 76 such as, for example, a hook and loop type fastener 76 as illustrated in FIG. 3. The user then connects another top resistance member 72 to the top wall 48 of the exercise device 20 via the top connecting member 76 and exercises in a manner similar to that described above.

A second exercise that may be performed with the exercise device 20 includes using the front resistance member 84. This exercise includes positioning a user's foot on the top wall 48 with his/her toes overhanging the front edge of the exercise device 20 and curling his/her toes downward around the front edge of the exercise device 20 to engage the front resistance member 84. Then, the user pulls his/her toes against the front resistance member 84 and releases his/her toes. This is repeated as desired by the user. If the user desires to replace the front resistance member 84 with another front resistance member 84 in order to alter the resistance level, the user pulls the front resistance member 84 away from the front wall 36 of the exercise device 20, thereby releasing the front connecting member 88 such as, for example, a hook and loop type fastener 88 as illustrated in FIG. 3. The user then connects another front resistance member 84 to the front wall 36 of the exercise device 20 via the front connecting member 88 and exercises in a manner similar to that described above.

A third exercise that may be performed with the exercise device 20 includes using the right or left resistance member 100, 104. This exercise includes positioning a user's right foot on a floor surface or ground to a right side of the exercise device 20 or positioning a user's left foot on a floor surface or ground to a left side of the exercise device 20. Whichever foot will be exercised, the user engages an interior side of his or her foot with the appropriate right or left resistance member 100, 104 and pushes inward against the right or left resistance member 100, 104. This is repeated as desired by the user. The user may desire to place the other non-exercising foot on the top wall 48 of the exercise device 20 to assist with maintaining the exercise device 20 in place while exercising. Alternatively, a user may simultaneously exercise both feet and push both feet toward each other, thereby providing substantially equal forces on opposing sides of the exercise device 20 to maintain its position. If the user desires to replace the right or left resistance member 100, 104 with another right or left resistance member 100, 104 in order to alter the resistance level, the user pulls the right or left resistance member 100, 104 away from the respective right or left side wall 28, 32 of the exercise device 20, thereby releasing the right or left connecting member 108, 112 such as, for example, a hook and loop type fastener 108, 112 as illustrated in FIG. 3. The user then connects another right or left resistance member 100, 104 to the respective right or left side wall 28, 32 of the exercise device 20 via the right or left connecting member 108, 112 and exercises in a manner similar to that described above.

A fourth exercise that may be performed with the exercise device 20 includes using the right or left resistance member 100, 104. This exercise includes positioning a user's right foot on a floor surface or ground to a left side of the exercise device 20 or positioning a user's left foot on a floor surface or ground to a right side of the exercise device 20. Whichever foot will be exercised, the user engages an outside of his or her foot with the appropriate right or left resistance member 100, 104 and pushes against the right or left resistance member 100, 104 with the outside of his/her foot. This is repeated as desired by the user. The user may desire to place the other non-exercising foot on the top wall 48 of the exercise device 20 to assist with maintaining the exercise device 20 in place while exercising. Alternatively, a user may simultaneously exercise both feet and push both feet toward each other, thereby providing substantially equal forces on opposing sides of the exercise device 20 to maintain its position. If the user desires to replace the right or left resistance member 100, 104 with another right or left resistance member 100, 104 in order to alter the resistance level, the user pulls the right or left resistance member 100, 104 away from the respective right or left side wall 28, 32 of the exercise device 20, thereby releasing the right or left connecting member 108, 112 such as, for example, a hook and loop type fastener 108, 112 as illustrated in FIG. 3. The user then connects another right or left resistance member 100, 104 to the respective right or left side wall 28, 32 of the exercise device 20 via the right or left connecting member 108, 112 and exercises in a manner similar to that described above.

A fifth exercise that may be performed with the exercise device 20 includes using the top wall 48 of the exercise device 20 to stretch a user's calf. This exercise includes placing the right or left foot on the top wall 48 and pressing downward through the heel and calf muscle. This calf stretching exercise may be combined with any of the other exercises described above or other exercises.

Figure 4:
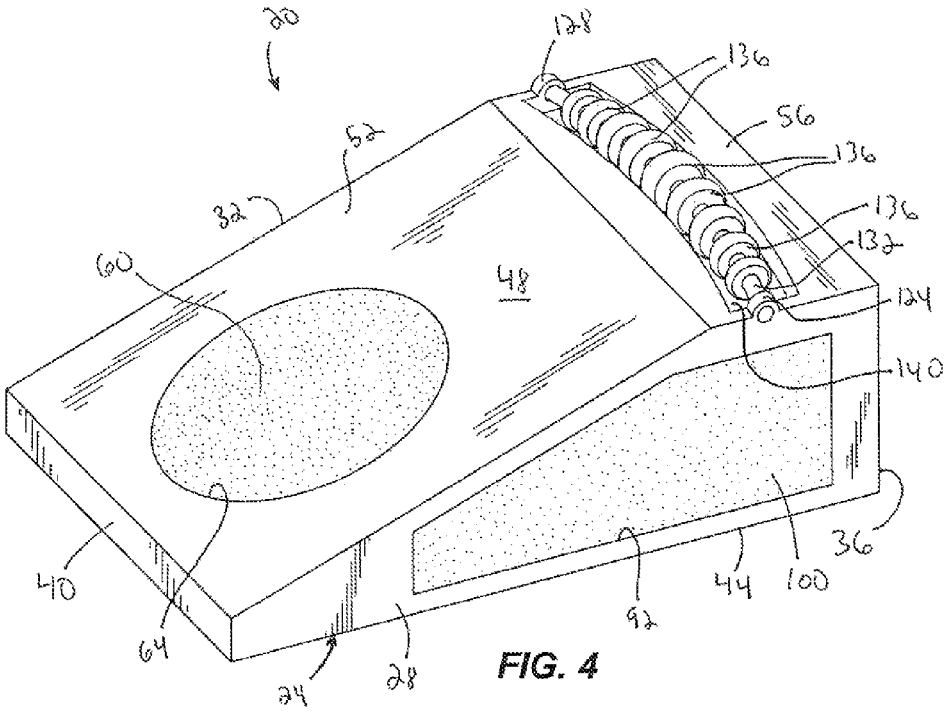
FIG. 4 is a top rear perspective view of another exemplary exercise device.

Referring now to FIG. 4, an alternative exemplary embodiment of an exercise device 20 is illustrated. Similar components between the exemplary exercise device 20 illustrated in FIG. 4 and other exemplary exercise devices 20 illustrated in other figures of the present application may be identified with the same reference numbers.

The exemplary exercise device 20 illustrated in FIG. 4 includes a first axle support 124 coupled to the housing 24 near an edge defined by the top wall 48 and the right wall 28, a second axle support 128 coupled to the housing 24 near an edge defined by the top wall 48 and the left wall 32, an axle 132 coupled at its ends to the first and second axle supports 124, 128, and a plurality of rollers 136 coupled to and rotatable around the axle 132. In this illustrated exemplary embodiment, the axle 132 is fixed in place and the rollers 136 rotate around the axle 132. Alternatively, the rollers 136 could be fixed to the axle 132 and the rollers 136 and axle 132 could rotate together. A cavity 140 may be defined in the top wall 48 of the exercise device 20 to receive a lower portion of the rollers 136 so that the rollers 136 are not spaced a significant distance above the top wall 48.

Returning to the illustrated exemplary embodiment, the rollers 136 have varying diameters with the largest roller in the middle and the rollers decreasing in diameter the further they are from the largest roller. The rollers 136 may have different diameters in order to accommodate toes of varying sizes and lengths. Alternatively, the rollers 136 may all be the same size or the rollers 136 may alter in size in a different configuration than that illustrated in FIG. 4.

A user may place his/her right or left foot on the exercise device 20 and align his/her big toe of the selected foot with the largest roller. Depending on the foot placed on the exercise device 20, the remaining four toes of the selected foot will align with the four rollers on that side of the largest roller. The user may push or pull his/her toes against the rollers 136, thereby causing the rollers 136 to rotate. The rollers 136 resist the user's toes as they are pushed or pulled against the rollers 136. The rollers 136 may provide any amount of resistance and may be adjustable to provide varying degrees of resistance.

Figure 5:
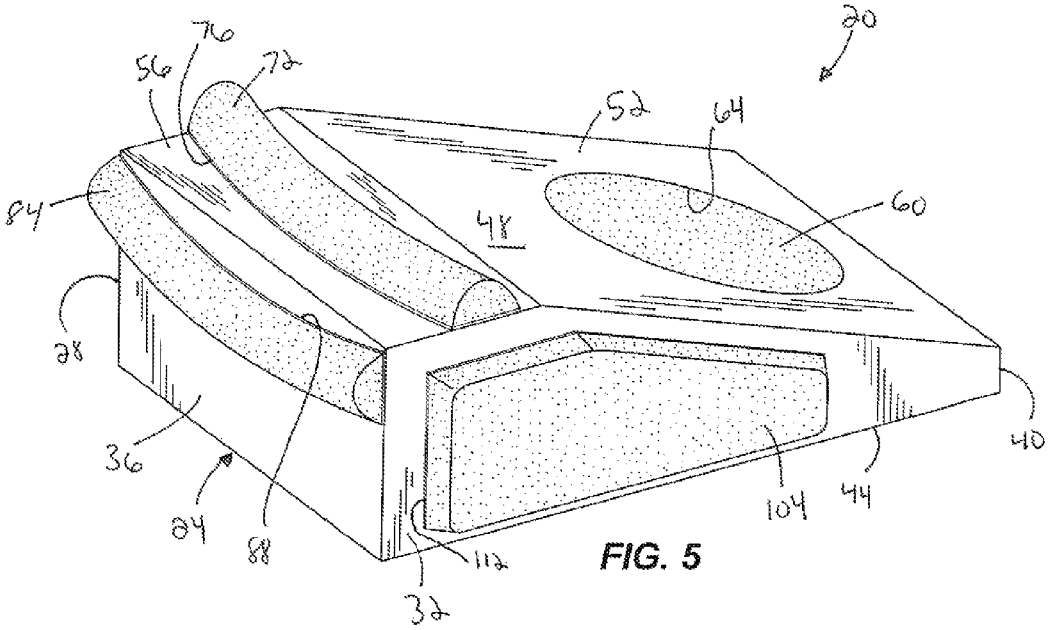
FIG. 5 is a top front perspective view of yet another exemplary exercise device.

Referring now to FIG. 5, another alternative exemplary embodiment of an exercise device 20 is illustrated. Similar components between the exemplary exercise device 20 illustrated in FIG. 5 and other exemplary exercise devices 20 illustrated in other figures of the present application may be identified with the same reference numbers.

The exemplary exercise device 20 illustrated in FIG. 5 includes a similar shaped housing 24 and similar shaped resistance members 72, 84, 100, 104 to the exercise device 20 illustrated in FIGS. 1-3, except the exercise device 20 illustrated in FIG. 5 includes resistance members 72, 84, 100, 104 that are coupled to respective walls and extend outwardly from the respective walls. For example, the top resistance member 72 is removably coupled to the top wall 48 and projects above the top wall 48. The one of the hook portion or loop portion of the hook and loop type fastener is coupled to the top wall 48 and the other of the hook portion and loop portion is coupled to the top resistance member 72. Also for example, the front resistance member 84 is removably coupled to the front wall 36 and projects in front of the front wall 36. The one of the hook portion or loop portion of the hook and loop type fastener is coupled to the front wall 36 and the other of the hook portion and loop portion is coupled to the front resistance member 84. Further for example, the right and left resistance members 100, 104 are respectively removably coupled to the right and left walls 28, 32 and project beyond the right and left walls 28, 32. The one of the hook portion or loop portion of the hook and loop type fastener is coupled to each of the right and left walls 28, 32 and the other of the hook portion and loop portion is coupled to each of the right and left resistance members 100, 104. Similarly to the exercise device 20 illustrated in FIGS. 1-3, the exercise device 20 illustrated in FIG. 5 may include multiple resistance members for providing varying degrees of resistance and such multiple resistance members are removably coupled to the housing 24 in the various manners described in connection with the exercise device 20 illustrated in FIGS. 1-3.

With the exercise device 20 illustrated in FIG. 5, a user may perform any of the exercises described above or other exercises in connection with the exercise device 20 illustrated in FIGS. 1-3. Therefore, such exercises will not be presented again herein with respect to FIG. 5.

Figure 6:
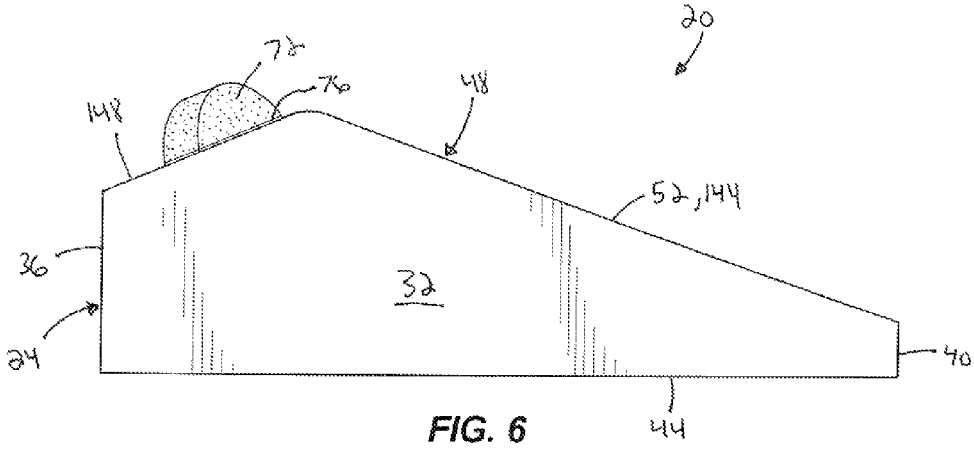
FIG. 6 is a side view of still another exemplary exercise device.

Referring now to FIG. 6, yet another alternative exemplary embodiment of an exercise device 20 is illustrated. Similar components between the exemplary exercise device 20 illustrated in FIG. 6 and other exemplary exercise devices 20 illustrated in other figures of the present application may be identified with the same reference numbers.

In this illustrated exemplary embodiment, the top wall 48 does not include a horizontal portion, but rather includes a first angled portion 144 and a second angled portion 148. The first angled portion 144 may be substantially similar to the angled portion 52 of the exercise device 20 illustrated in FIGS. 1-3. The second angled portion 148 angles downward toward the front wall 36 of the housing 24. In this illustrated exemplary embodiment, the top resistance member 72 is positioned on the second angled portion 148. This configuration of the top resistance member 72 on the second angled portion 148 provides a different angle for the user to exercise his/her toes than the angle provided by the exercise device 20 illustrated in FIGS. 1-3. The first and second angled portions 144, 148 may be angled at any degree and be within the intended spirit and scope of the present invention.

Figure 7:
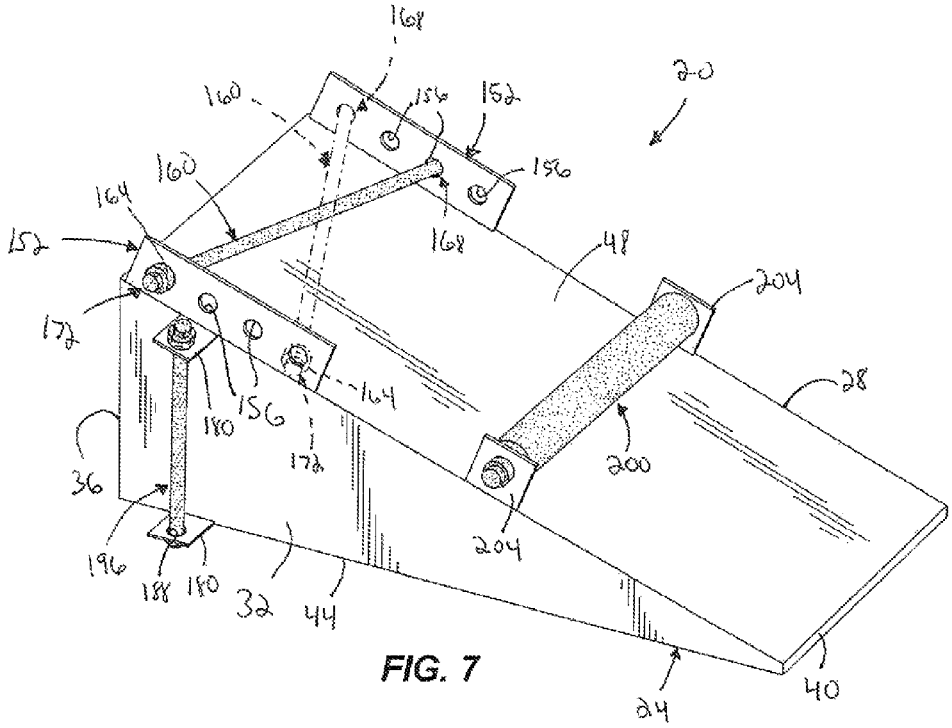
FIG. 7 is a top rear perspective view of a further exemplary exercise device.
Figure 8:
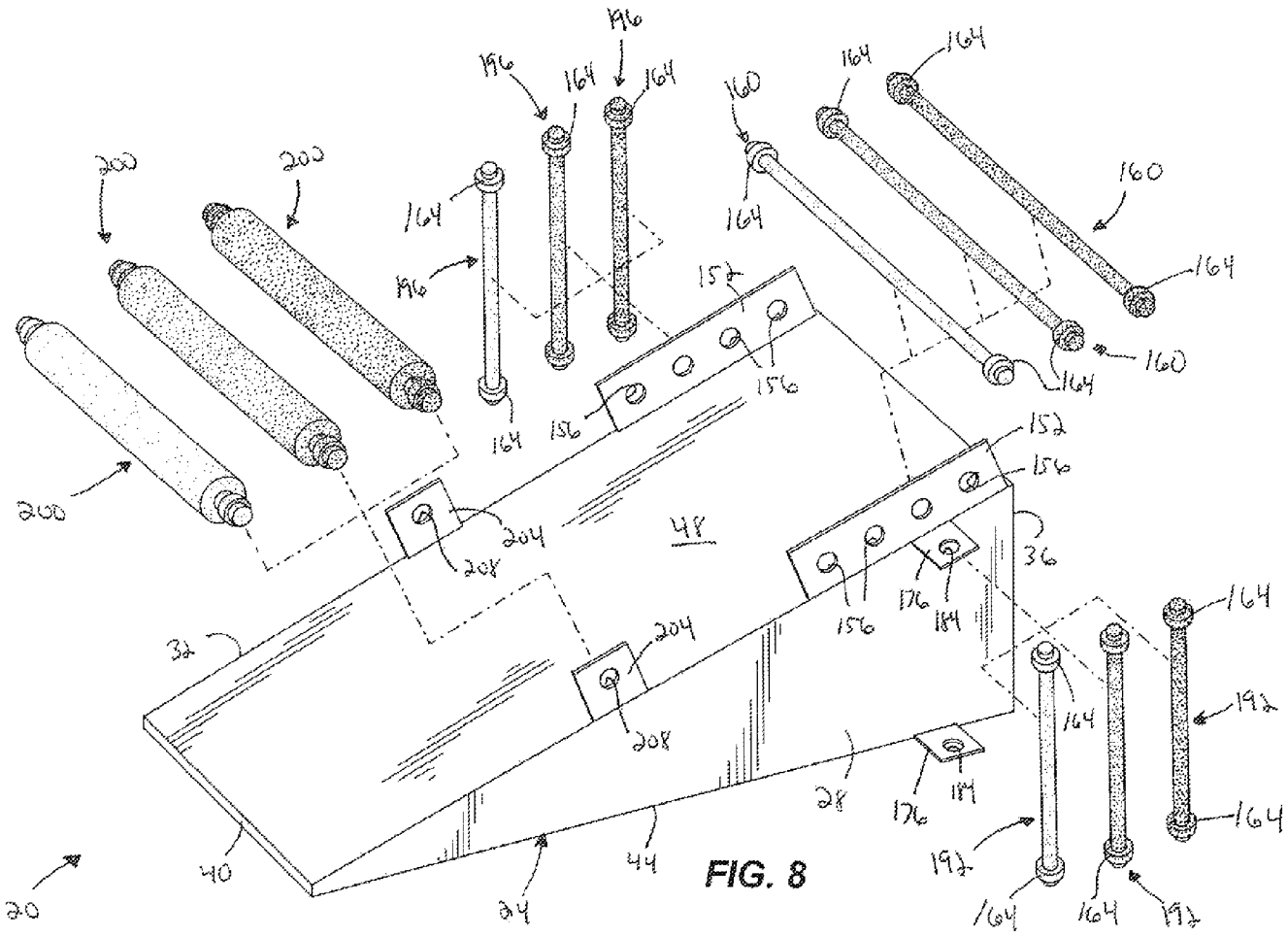
FIG. 8 is a top rear perspective view of the exercise device shown in FIG. 7, the exercise device is shown with a plurality of interchangeable resistance members and a plurality of interchangeable arch massage members.

Referring now to FIGS. 7 and 8, still another alternative exemplary embodiment of an exercise device 20 is illustrated. Similar components between the exemplary exercise device 20 illustrated in FIGS. 7 and 8 and other exemplary exercise devices 20 illustrated in other figures of the present application may be identified with the same reference numbers.

The exercise device 20 illustrated in FIGS. 7 and 8 includes resistance members that may be similar in function to the resistance members illustrated in FIGS. 1-6, however, the resistance members in FIGS. 7 and 8 generally have a form of a tube made of a resilient material. The tubes may be made of a variety of different resilient materials such as, for example, rubber, soft plastic, or any other appropriate resilient material and be within the intended spirit and scope of the present invention. In addition, due to the different configuration of the resistance members illustrated in FIGS. 7 and 8, the exercise device 20 couples the resistance members to the housing 24 in a different manner, which will be described in more detail below.

With continued reference to FIGS. 7 and 8, a pair of connecting members 152 are coupled to the top wall 48 of the exercise device 20 and each connecting member 152 defines a plurality of apertures 156 there through. In the illustrated exemplary embodiment, the connecting members 152 are rectangular and include four apertures 156 each. Alternatively, the connecting members 152 may have different shapes and include any number of apertures 156 there through and be within the intended spirit and scope of the present invention. A top resistance member 160 is removably coupled to the connecting members 152 and includes an enlarged portion 164 near both ends of the top resistance member 160. As indicated above, the top resistance member 160 is made of a resilient material, which includes the enlarged portions 164 as well. The top resistance member 164 is coupled to the connecting members 152 by pushing or pulling a first of the enlarged portions 164 through an aperture 156 in one of the connecting members 152 and pushing or pulling a second of the enlarged portions 164 through an aperture 156 in the other connecting member 152. The enlarged portions 164 are sufficiently flexible to allow them to be pushed or pulled through the apertures 156 in the connecting members 152, but sufficiently rigid to inhibit them from being pulled through the apertures 156 during normal operation of the exercise device 20. Preferably, the enlarged portions 164 may only be removed from the apertures 156 when a user exerts sufficient pulling force on the top resistance member 160 with the intention of removing the top resistance member 160 from the connecting members 152.

The plurality of apertures 156 defined in the connecting members 152 provides multiple orientations at which the top resistance member 160 may be positioned. These multiple orientations allow the exercise device 20 to accommodate both right and left feet of a user and additionally provide multiple orientations for each of the right foot and the left foot to further accommodate a user. For example, with reference to FIG. 7, the solid line representation of the top resistance member 160 is oriented to accommodate a right foot of a user. This illustrated orientation of the top resistance member 160 is only one of several orientations a user may use for his/her right foot. As illustrated, the distal end 168 of the top resistance member 160 may be moved one aperture 156 to the right to provide a more drastic angle of the top resistance member 160 for a user's right foot or the distal end 168 of the top resistance member 160 may be moved one aperture 156 to the left to provide a less drastic angle. The proximate end 172 may also be moved to provide additional orientations for the right foot. Additionally for example, with reference to FIG. 7, the phantom line representation of the top resistance member 160 is oriented to accommodate a left foot of a user. This illustrated orientation of the top resistance member 160 is only one of several orientations a user may use for his/her left foot. As illustrated, the proximate end 172 of the top resistance member 160 may be moved one aperture 156 to the left to provide a less drastic angle of the top resistance member 160 for a user's left foot or the top resistance member 160 may be moved two apertures 156 to the left to provide an even less drastic angle. The distal end 168 may also be moved to provide additional orientations for the left foot. The multiple angled orientations of the top resistance member 160 may be beneficial for a variety of reasons. One such reason may be to accommodate toes of different length and feet of different sizes. The top resistance member 160 may also be oriented straight across by coupling ends of the top resistance member 160 in corresponding linearly aligned apertures 156.

With continued reference to FIGS. 7 and 8, a pair of right side connecting members 176 and a pair of left side connecting members 180 are respectively coupled to right and left walls 28, 32 of the housing 24. In the illustrated exemplary embodiment, each pair of the right and left side connecting members 176, 180 includes a single aperture 184, 188 there through to which right and left resistance members 192, 196 respectively couple in a manner similar to that of the top resistance member 160. A single aperture 184, 188 in each of the pairs of right and left side connecting members 176, 180 provides only a single mounting orientation for the right and left resistance members 192, 196. Alternatively, the pairs of right and left side connecting members 176, 180 may be larger in size and may include multiple apertures, thereby providing multiple mounting orientations for the right and left resistance members 192, 196.

An arch massage member 200 is coupled to the top wall 48 via a pair of arch connecting members 204. The arch massage member 200 is coupled lower down on the top wall 48 in the vicinity of a user's arch when a user properly positions his/her foot on the exercise device 20. In the illustrated exemplary embodiment, the pair of arch connecting members 204 only define a single aperture 208 there through to provide only a single mounting orientation of the arch massage member 200. Alternatively, the pair of arch connecting members 204 may be larger in size and may define a plurality of apertures 204 there through to provide a plurality of mounting orientations for the arch massage member 200. Also in the illustrated exemplary embodiment, the arch massage member 200 is larger in size than the resistance members 160, 192, 196. One exemplary reason the arch massage member 200 may be larger is so the arch massage member 200 may engage a larger portion of a user's arch, thereby massaging a larger portion of the user's arch during use of the exercise device 20. It should be understood that the arch massage member 200 may be made out of a variety of different materials and may have a variety of different configurations and still be within the intended spirit and scope of the present invention. For example, the arch massage member 200 may be made of foam, rubber, plastic, etc., and may include a smooth surface, a rough surface, a surface with projections, etc.

With particular reference to FIG. 8, an exploded view of the exemplary exercise device 20 is illustrated to exemplify the exercise device's ability to provide varying resistance and varying arch massage to a user when exercising his/her feet. In this illustrated exemplary embodiment, the varying resistance is provided by using multiple interchangeable resistance members. Variable resistance may be provided in different manners and still be within the intended spirit and scope of the present invention. For exemplary purposes, the exercise device 20 is shown to include three of each of the top, right, and left resistance members 160, 192, 196. The exemplary illustration of three resistance members is not intended to be limiting and any number of resistance members may be used to provide varying degrees of resistance adjustability.

With continued reference to FIG. 8, a plurality of top resistance members 160 are illustrated and each of the plurality of top resistance members 160 provide a different amount of resistance, which is aesthetically represented in FIG. 8 by the different shading methods. The varying amounts of resistance may be provided in a variety of different manners. For example, the plurality of top resistance members 160 may be made out of different materials or may be made of a similar material, but the top resistance members 160 may have varying densities or rigidities. No matter the manner used to achieve varying resistances, a user couples the desired top resistance member 160 to the connecting members 152 for use during exercise. Similar to the resistance members associated with FIGS. 1-3 above, the resistance members 160 of this exemplary embodiment may be uniquely marked to assist a user with identifying a desired resistance member 160.

The preceding remarks relating to the top resistance member 160 and achieving varying levels or resistance also apply to the right and left resistance members 192, 196 and, therefore, will not be repeated herein.

A plurality of arch massage members 200 may also be interchangeably coupled to the exercise device 20 to provide different massage experiences. Similarly to the resistance members 160, 192, 196, FIG. 8 only illustrates three arch massage members 200. The illustration of three arch massage members 200 is not intended to be limiting because the exercise device 20 may include any number of arch massage members 200 and still be within the intended spirit and scope of the present invention.

The various arch massage members 200 may differ in a variety of manners to provide different massage experiences. For example, the arch massage members 200 may have varying rigidities, varying surface finishes (e.g., rough, not as rough, and smooth), varying sizes (e.g., varying diameters), varying shapes (e.g., round, square, oval), varying manners of connection (e.g., some arch massage members 200 may rotate, while others are fixed and do not rotate), etc. Arch massage members 200 may also be uniquely marked to assist a user with identifying a desired arch massage member 200.

Figure 9:
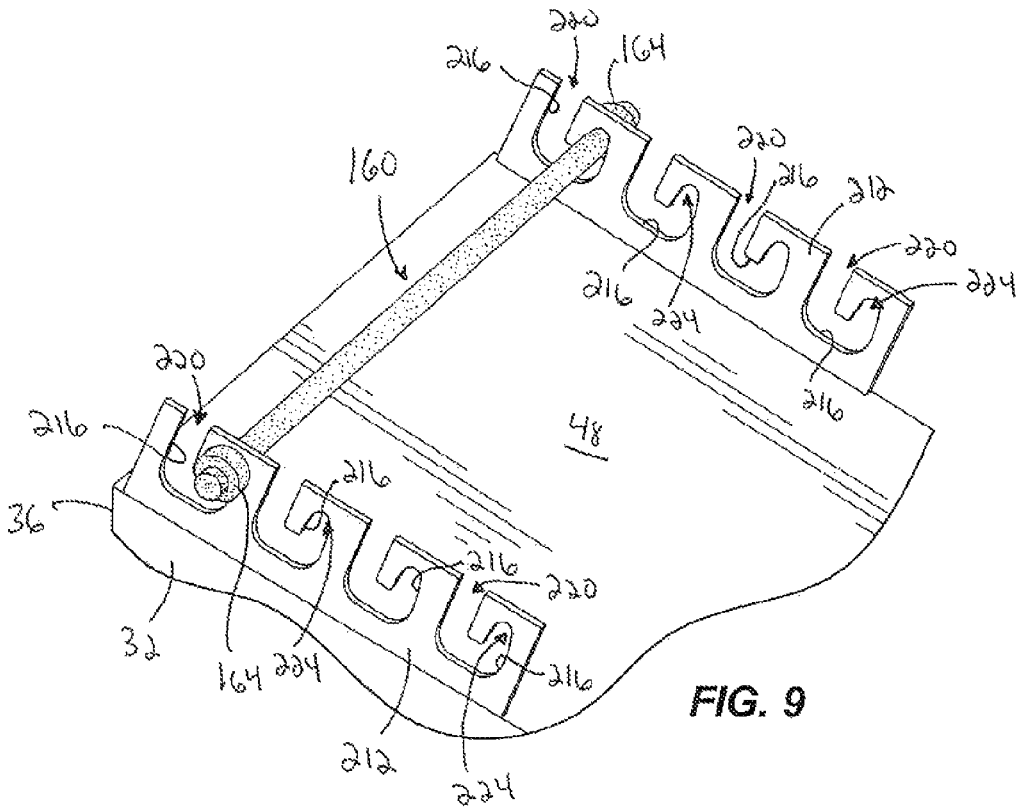
FIG. 9 is a partial top rear perspective view of the exercise device shown in FIG. 7 with an alternative exemplary embodiment of a pair of connecting members.

Referring now to FIG. 9, another alternative exemplary embodiment of a pair of connecting members 212 is illustrated. Similar components between the exemplary pair of connecting members 212 illustrated in FIG. 9 and other exemplary connecting members illustrated in other figures of the present application may be identified with the same reference numbers.

In the illustrated exemplary embodiment, this alternative pair of connecting members 212 is shown coupled to the top wall 48 of the exercise device 20 to connect the top resistance member 160 to the exercise device 20. It should be understood that the concepts of this alternative embodiment of connecting members 212 may be applied to any connecting members of the exercise device 20 such as, for example, the right side connecting members and the left side connecting members.

With continued reference to FIG. 9, the illustrated exemplary pair of connecting members 212 include a plurality of apertures 216 having a different configuration than the apertures 156 illustrated in FIGS. 7 and 8 and described above. More particularly, the apertures 216 include a counter-clockwise rotated "C" shape (as viewed in FIG. 9) with a first end 220 of the "C" shaped apertures 216 defined through a top edge of the connecting members 212 and open to the environment, and a second end 224 of the "C" shaped aperture 216 stopped short of the top edge of the connecting members 212 to provide a dead end 224 to the "C" shaped aperture 216.

To couple a top resistance member 160 to the top connecting members 212, a user stretches the top resistance member 160 such that the enlarged portions 164 are on respective outsides of the top connecting members 212, moves the top resistance member 160 downward into the open ends 220 of the apertures 216, follows the apertures 216 around to the dead ends 224 of the apertures 216, and positions the top resistance member 160 in the dead ends 224 of the apertures 216. The dead ends 224 of the apertures 216 may be reduced in size or diameter relative to other portions of the apertures 216 such that the top resistance member 160 is pinched, interference or friction fit, or otherwise secured in the dead ends 224. Such a securement in the dead ends 224 of the apertures 216 inhibits the top resistance member 160 from moving out of the apertures 216 during normal operation of the exercise device 20. Additionally, the enlarged portions 164 are larger than the size of the apertures 216 and inhibit the top resistance member 160 from being pulled from the apertures 216 during normal operation of the exercise device 20. To remove the top resistance member 160 from the apertures 216, a user needs to apply sufficient downward force to the top resistance member 160 to dislodge it from the dead ends 224 of the apertures 216. Upon dislodgement of the top resistance member 160 from the dead ends 224 of the apertures 216, a user moves the top resistance member 160 through the "C" shaped apertures 216 until it exits the apertures 216.

Figure 10:
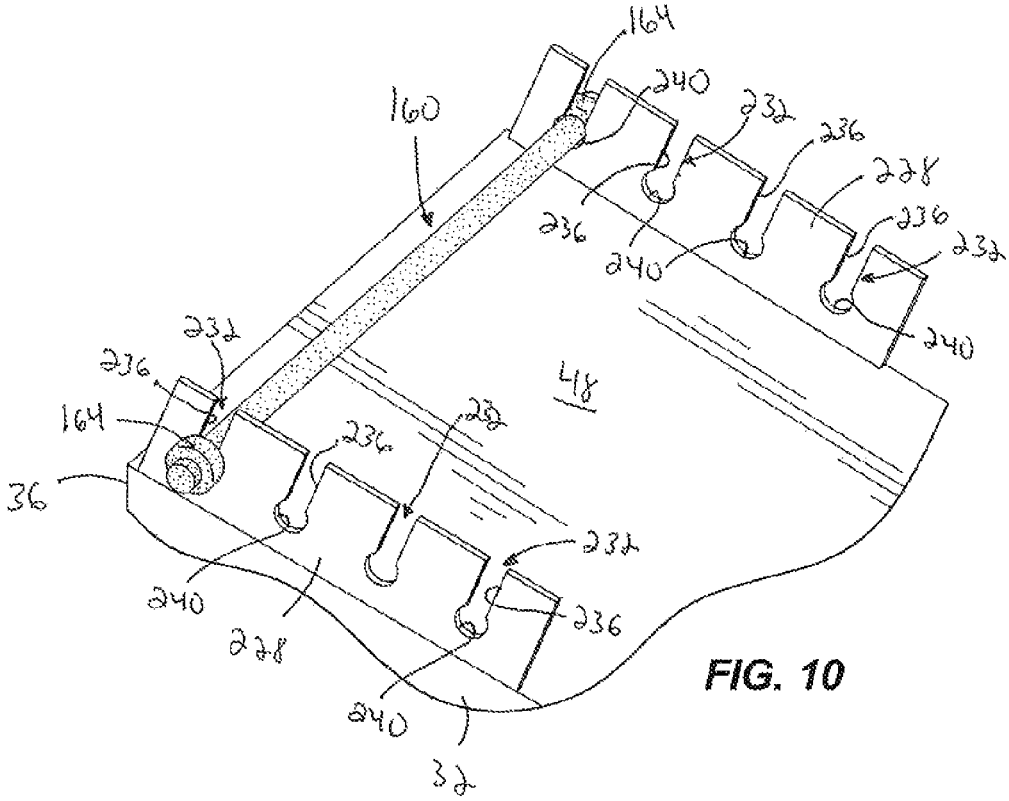
FIG. 10 is a partial top rear perspective view of the exercise device shown in FIG. 7 with another alternative exemplary embodiment of a pair of connecting members.

Referring now to FIG. 10, yet another alternative exemplary embodiment of a pair of connecting members 228 is illustrated. Similar components between the exemplary pair of connecting members 228 illustrated in FIG. 10 and other exemplary connecting members illustrated in other figures of the present application may be identified with the same reference numbers.

In the illustrated exemplary embodiment, this alternative pair of connecting members 228 is shown coupled to the top wall 48 of the exercise device 20 to connect the top resistance member 160 to the exercise device 20. It should be understood that the concepts of this alternative embodiment of connecting members 228 may be applied to any connecting members of the exercise device 20 such as, for example, the right side connecting members and the left side connecting members.

With continued reference to FIG. 10, the illustrated exemplary pair of connecting members 228 include a plurality of apertures 232 having a different configuration than the apertures illustrated in FIGS. 7-9 and described above. More particularly, the apertures 232 are generally linear in shape and extend perpendicularly from the top edge of the connecting members 228. Each aperture 232 includes a generally linear portion 236 and a rounded portion 240. The linear portion 236 has a first or open end thereof defined through a top edge of the connecting members 228 and open to the environment, and a second or bottom end in communication with the rounded portion 240. The rounded portion 240 is larger in width than the linear portion 236. Relative to the top resistance member 160, the linear portion 236 has a width less than the width of the top resistance member 160 and the rounded portion 240 has a width close to the width of the top resistance member 160 such as, for example, the same width, slightly larger width, or slightly less width.

To couple a top resistance member 160 to the top connecting members 228, a user stretches the top resistance member 160 such that the enlarged portions 164 are on respective outsides of the top connecting members 228 and moves the top resistance member 160 downward into the open ends of the linear portions 236 of the apertures 232. Since the width of the linear portion 236 is less than the width of the top resistance members 160, a user must force the top resistance member 160 downward into the linear portions 236 of the apertures 232. Such forcing of the top resistance member 160 will cause some deformation thereof. A user continues to force the top resistance member 160 downward until it moves into the rounded portion 240 of the apertures 232. Once in the rounded portions 240 of the apertures 232, the top resistance member 160, due to its resiliency, is able to return to or close to its normal shape. The narrowing transition from the rounded portion 240 to the linear portion 236 is sufficient to retain the top resistance member 160 in the round portions 240 of the apertures 232 during normal use of the exercise device 20. To remove the top resistance member 160 from the apertures 232, a user needs to apply sufficient upward force to the top resistance member 160 to move it from the rounded portion 240 of the apertures 232 to the linear portion 236 of the apertures 232. The user continues to move the top resistance member 160 upward until it is completely removed from the apertures 232.

Figure 11:
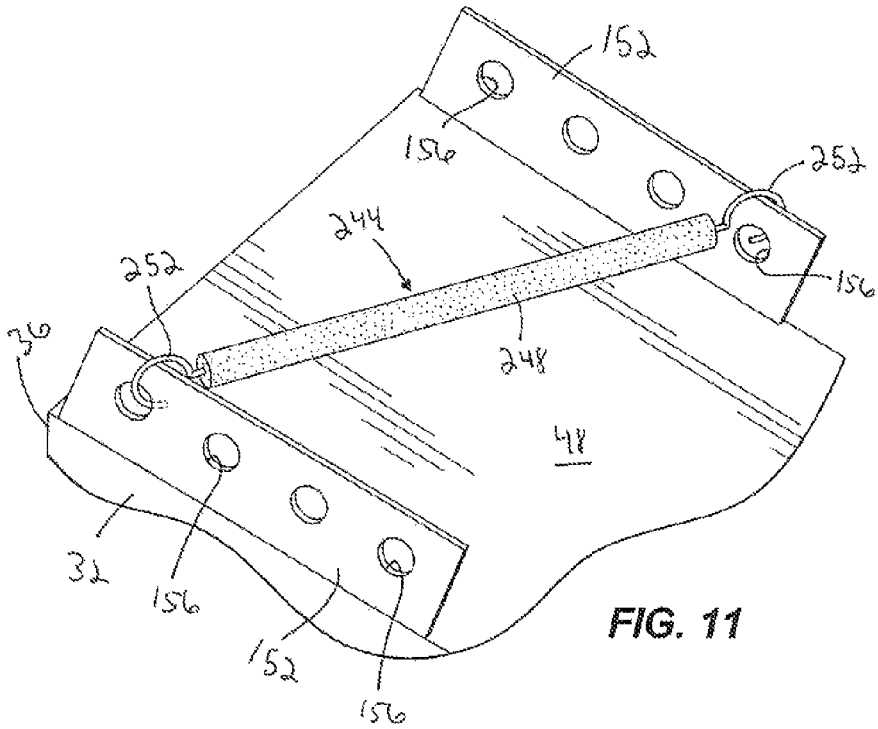
FIG. 11 is a partial top rear perspective view of the exercise device shown in FIG. 7 with an alternative exemplary embodiment of a resistance member.

Referring now to FIG. 11, yet other alternative exemplary embodiments of a pair of connecting members and resistance member are illustrated. Similar components between the exemplary pair of connecting members and resistance member illustrated in FIG. 11 and other exemplary connecting members and resistance members illustrated in other figures of the present application may be identified with the same reference numbers.

With continued reference to FIG. 11, the illustrated exemplary pair of connecting members 152 are similar to the connecting members 152 illustrated in FIGS. 7 and 8. The resistance member 244 includes a resilient portion 248 and a connecting hook 252 coupled to each end of the resilient portion 248. One of the connecting hooks 252 connects to a respective one of the connecting members 152. In a similar manner to the embodiments illustrated in FIGS. 7-10, the resistance member 244 may be coupled to the connecting members 152 in a variety of different orientations to accommodate both feet and to provide multiple exercise positions per foot.

The connecting hooks 252 may have a variety of configurations other than that illustrated in FIG. 11. For example, the hooks 252 may be larger, smaller, a shape other than semicircular, etc. Also, in the alternative, the resistance member 244 may be coupled to the connecting members 152 in a variety of manners. For example, instead of hooks, the resistance member 244 may include snaps, clips (e.g., an alligator clip), adhesive, or any other type of connecting device.

With continued reference to FIG. 11, to couple the resistance member 244 to the connecting members 152, a user stretches the resilient portion 248 of the resistance member 244 such that the hooks 252 are on respective outsides of the connecting members 152 and moves the resistance member 244 downward toward the connecting members 152. The hooks 252 are aligned with and inserted into the apertures 156. Once the hooks 252 are positioned in the apertures 156 of the connecting members 152, the user may release the resistance member 244 and the resistance member 244 will be secured to the connecting members 152 under tension. To remove the resistance member 244 from the apertures 156 of the connecting members 152, a user needs to apply sufficient outward force to the resilient portion 248 and/or hooks 252 of the resistance member 244 to move the hooks 252 outwardly out of the apertures 156. The user continues to move the hooks 252 outward and upward until the resistance member 244 is completely removed from the apertures 156.

Figure 12:
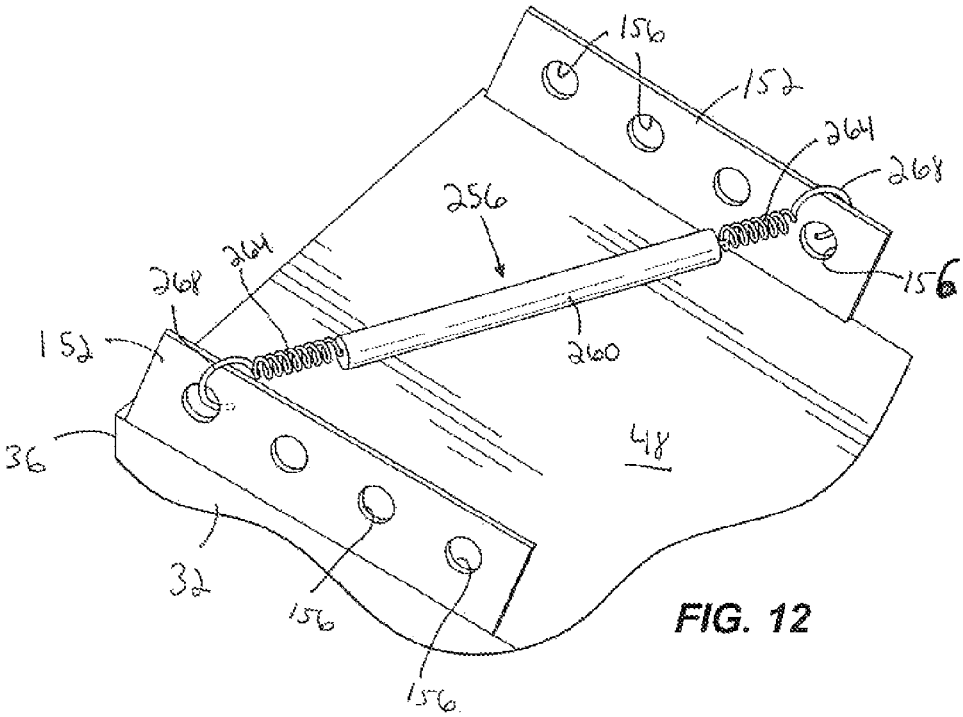
FIG. 12 is a partial top rear perspective view of the exercise device shown in FIG. 7 with another alternative exemplary embodiment of a resistance member.

Referring now to FIG. 12, yet other alternative exemplary embodiments of a pair of connecting members and resistance member are illustrated. Similar components between the exemplary pair of connecting members and resistance member illustrated in FIG. 12 and other exemplary connecting members and resistance members illustrated in other figures of the present application may be identified with the same reference numbers.

The connecting members 152 illustrated in FIG. 12 are similar to connecting members 152 illustrated in FIGS. 7, 8, and 11. In this illustrated exemplary embodiment, the resistance member 256 includes a rigid portion 260, a biasing member 264 (e.g., a spring) coupled to each end of the rigid portion 260, and a hook 268 coupled to each of the biasing members 264 for coupling the resistance member 256 to the connecting members 152. The rigid portion 260 may be made of a variety of different materials such as, for example, metal, wood, plastic, or any other rigid material. The biasing members 264 may be a variety of different types of biasing members such as, for example, a coil spring, a leaf spring, a resilient member made of, for example, rubber, soft plastic, etc. Additionally, the biasing members 264 may have a wide variety of resistances to provide varying resistances to a user during exercise. Multiple interchangeable resistance members 256 may be provided with the exercise device 20 and each resistance member 256 may have biasing members 264 of varying resistances to provide a user with flexibility in choosing his/her resistance level. Similarly to the embodiment illustrated in FIG. 11, the connecting hooks 268 may have a variety of different configurations for connecting the resistance member 256 to the connecting members 152. For example, the connecting hooks 268 may be snaps, clips (e.g., an alligator clip), adhesive, or any other type of connecting device. It should also be understood that the resistance member 256 may be coupled to and removed from the exercise device 20 in similar manners to that described above in connection with FIG. 11 and such description will not be presented again herein.

It should be understood that the various exemplary embodiments of connecting members and manners of connecting resistance members to connecting members illustrated in FIGS. 7-12 are for exemplary and illustrative purposes and are not intended to be limiting. Other configurations of connecting members and other manners of connecting resistance members to connecting members are possible and are intended to be within the spirit and scope of the present invention.

Figure 13:
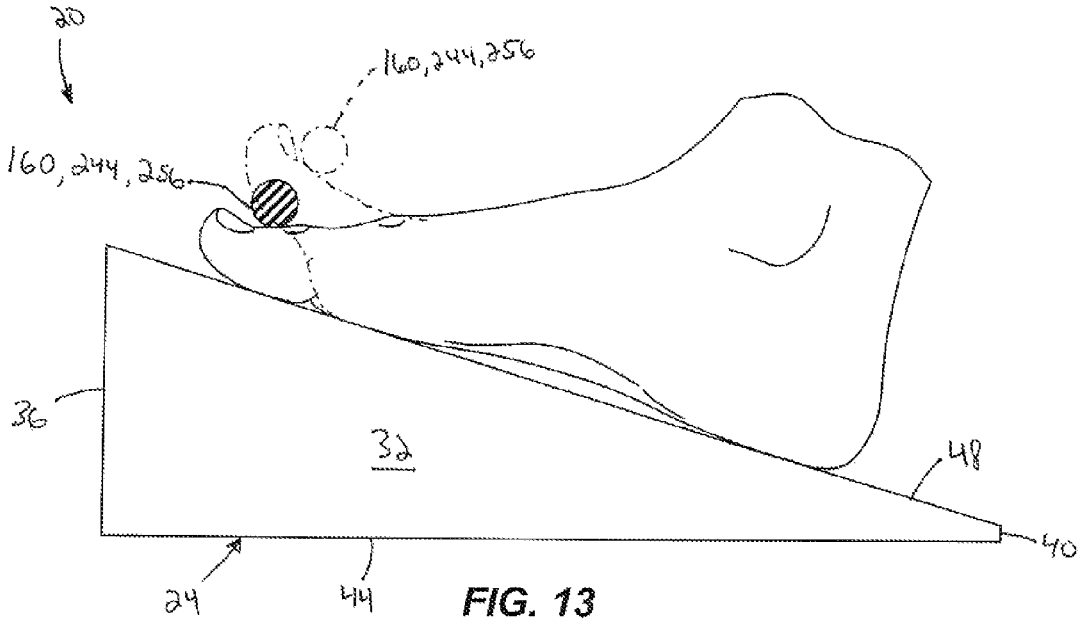
FIG. 13 is a schematical side view of the exercise device shown in FIG. 7, shown with a user's foot positioned on the exercise device and performing a first exercise.
Figure 14:
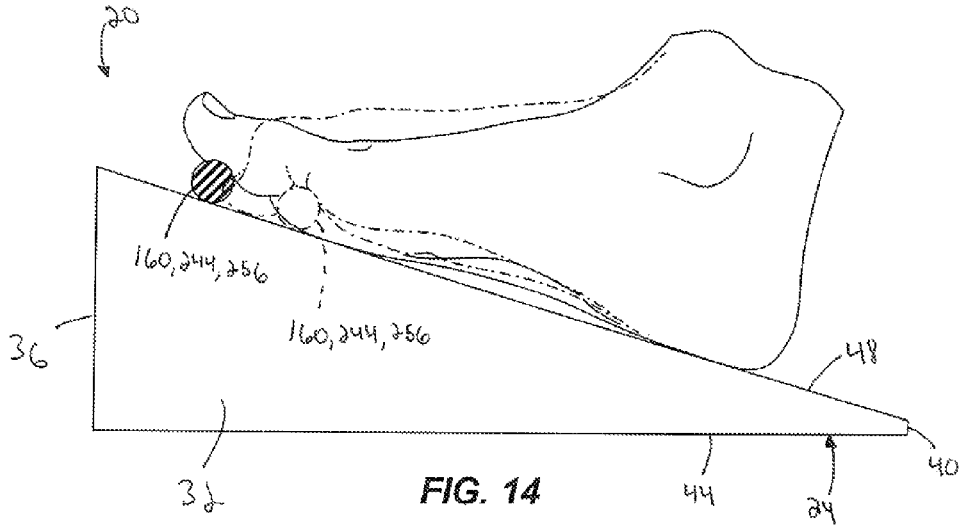
FIG. 14 is a schematical side view of the exercise device shown in FIG. 7, shown with a user's foot positioned on the exercise device and performing a second exercise.
Figure 15:
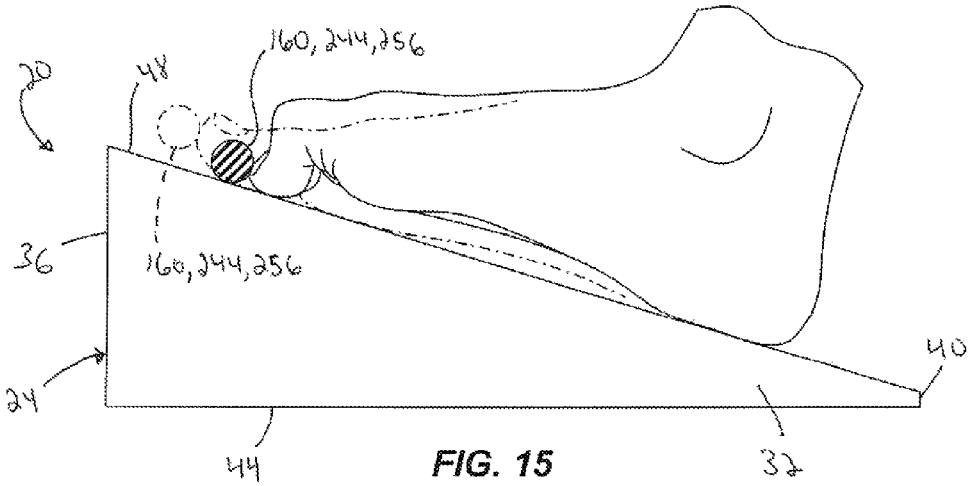
FIG. 15 is a schematical side view of the exercise device shown in FIG. 7, shown with a user's foot positioned on the exercise device and performing a third exercise.

Now that the structure of various embodiments of exercise devices 20 illustrated in FIGS. 7-12 has been described, exemplary operations and exercises of the exercise device 20 will be described herein. These exemplary operations and exercises are not intended to be limiting. Rather, the exercise device 20 is capable of performing other operations and exercises and any such operations and exercises are intended to be within the spirit and scope of the present invention. For example, FIGS. 13-15 illustrate exercises performable by a user's foot with the top resistance member 160, 244, 256. Clearly, other exercises may be performed with the right, left, and front resistance members and such exercises are intended to be within the spirit and scope of the present invention.

Referring to FIG. 13, the illustrated resistance member may be any of the resistance members described herein or any other alternatives or equivalents. Additionally, the housing 24 may be any of the housings described herein or any other alternatives or equivalents. A user places his/her toes under the top resistance member 160, 244, 256 (illustrated in solid lines) and lifts his/her toes upwardly against the top resistance member 160, 244, 256 (illustrated in phantom lines), thereby providing resistance to the upward movement of the user's toes. A user may repeat this exercise as desired. A user may also choose to interchangeably couple other resistance members 160, 244, 256 having more or less resistance to the housing 24 to provide the user with varying resistance levels of exercise.

Referring to FIG. 14, the illustrated resistance member may be any of the resistance members described herein or any other alternatives or equivalents. Additionally, the housing 24 may be any of the housings described herein or any other alternatives or equivalents. A user places his/her toes on top of the resistance member 160, 244, 256 (illustrated in solid lines) and pulls his/her toes rearwardly toward his/her heel against the top resistance member 160, 244, 256 (illustrated in phantom lines), thereby providing resistance to the rearward movement of the user's toes. A user may repeat this exercise as desired. A user may also choose to interchangeably couple other resistance members 160, 244, 256 having more or less resistance to the housing 24 to provide the user with varying resistance levels of exercise.

Referring to FIG. 15, the illustrated resistance member may be any of the resistance members described herein or any other alternatives or equivalents. Additionally, the housing 24 may be any of the housings described herein or any other alternatives or equivalents. A user rearwardly curls his/her toes and places a front of his/her toes against a rear of the resistance member 160, 244, 256 (illustrated in solid lines). The user then pushes his/her toes forward away from his/her heel against the top resistance member 160, 244, 256 (illustrated in phantom lines), thereby providing resistance to the forward movement of the user's toes. A user may repeat this exercise as desired. A user may also choose to interchangeably couple other resistance members 160, 244, 256 having more or less resistance to the housing 24 to provide the user with varying resistance levels of exercise.

The arch massage member 200 may engage and provide a massaging action to a user's arch during the above described exercises. In addition, a user may desire to only massage his/her arch without also exercising other portions of his/her foot. In such an instance, a user may move his/her arch back and forth over the arch massage member 200 as desired. A user may desire to adjust the rigidity, texture or other characteristic of the arch massage member 200 and does so by interchanging the arch massage member 200 with another one of the plurality of interchangeable arch massager members 200 (see FIG. 8).

Another exercise that may be performed with the exercise device 20 illustrated in FIGS. 7 and 8 uses the right or left resistance member 192, 196. This exercise includes positioning a user's right foot on a floor surface or ground to a right side of the exercise device 20 or positioning a user's left foot on a floor surface or ground to a left side of the exercise device 20. Whichever foot will be exercised, the user engages an interior side of his or her foot with the appropriate right or left resistance member 192, 196 and pushes inward against the right or left resistance member 192, 196. This is repeated as desired by the user. The user may desire to place the other non-exercising foot on the top wall 48 of the exercise device 20 to assist with maintaining the exercise device 20 in place while exercising. Alternatively, a user may simultaneously exercise both feet and push both feet toward each other, thereby providing substantially equal forces on opposing sides of the exercise device 20 to maintain its position. If the user desires to replace the right or left resistance member 192, 196 with another right or left resistance member 192, 196 in order to alter the resistance level, the user disconnects the right or left resistance member 192, 196 from the respective right or left connecting members 176, 180 of the exercise device 20 as illustrated in FIG. 8. The user then connects another right or left resistance member 192, 196 to the respective right or left connecting member 176, 180 of the exercise device 20 and exercises in a manner similar to that described above.

A further exercise that may be performed with the exercise device 20 includes using the right or left resistance member 192, 196. This exercise includes positioning a user's right foot on a floor surface or ground to a left side of the exercise device 20 or positioning a user's left foot on a floor surface or ground to a right side of the exercise device 20. Whichever foot will be exercised, the user engages an outside of his or her foot with the appropriate right or left resistance member 192, 196 and pushes against the right or left resistance member 192, 196 with the outside of his/her foot. This is repeated as desired by the user. The user may desire to place the other non-exercising foot on the top wall 48 of the exercise device 20 to assist with maintaining the exercise device 20 in place while exercising. Alternatively, a user may simultaneously exercise both feet and push both feet toward each other, thereby providing substantially equal forces on opposing sides of the exercise device 20 to maintain its position. If the user desires to replace the right or left resistance member 192, 196 with another right or left resistance member 192, 196 in order to alter the resistance level, the user disconnects the right or left resistance member 192, 196 from the respective right or left connecting members 176, 180 of the exercise device 20 as illustrated in FIG. 8. The user then connects another right or left resistance member 192, 196 to the respective right or left connecting members 176, 180 of the exercise device 20 and exercises in a manner similar to that described above.

Figure 16:
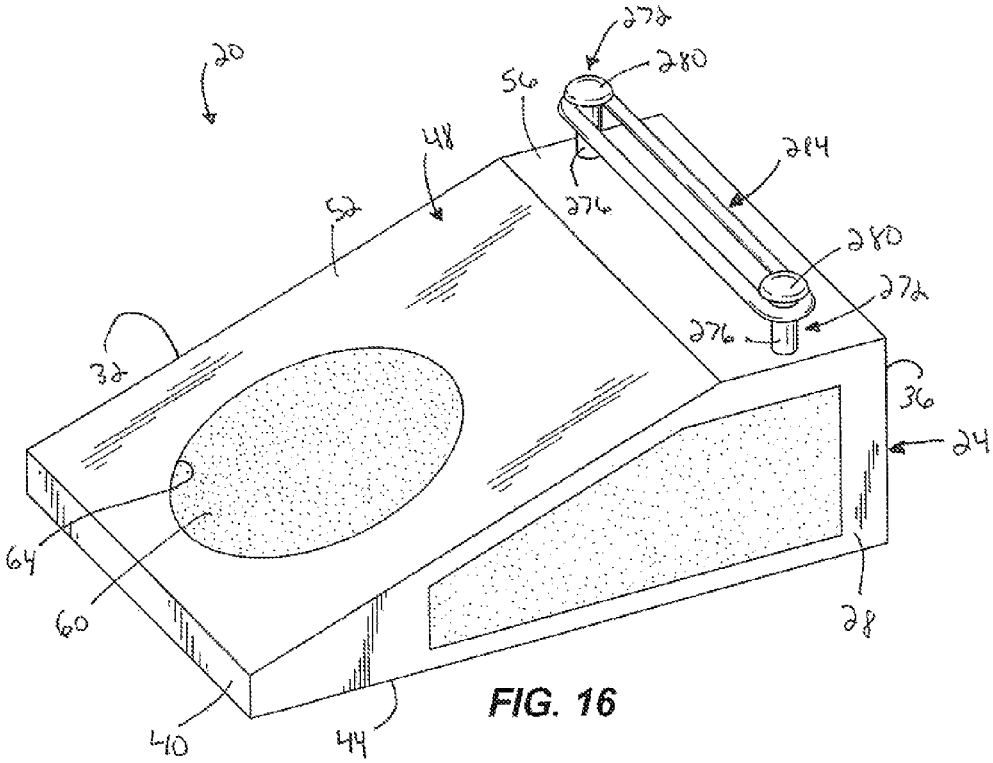
FIG. 16 is a top rear perspective view of yet a further exemplary embodiment of an exercise device.

Referring now to FIG. 16, a further alternative exemplary embodiment of an exercise device 20 is illustrated. Similar components between the exemplary exercise device 20 illustrated in FIG. 16 and other exemplary exercise devices 20 illustrated in other figures of the present application may be identified with the same reference numbers.

The exercise device 20 illustrated in FIG. 16 includes a pair of connecting members 272 coupled to a top wall 48 of the housing 24. In this illustrated exemplary embodiment, the connecting members 272 are vertically orientated pegs with each including a base 276 extending upward from the top wall 48 and an enlarged portion 280 on top of the base 276. The enlarged portion 280 has a larger width than the base 276. Also in the illustrated exemplary embodiment, a top resistance member 284 is substantially loop-shaped and is positioned around the two connecting members 272 under tension. The enlarged portion 280 of the connecting members 272 inhibits the top resistance member 284 from sliding off the top of the connecting members 272 and dislodging from the exercise device 20. The user may perform all the same exercises that may be performed with the other top resistance members disclosed herein.

It should be understood that the connecting members 272 and resistance member 284 illustrated in FIG. 16 may have a variety of different configurations and still be within the intended spirit and scope of the present invention.

It should also be understood that resistance members other than the top resistance member 284 illustrated in FIG. 16 may have a similar configuration. For example, the right, left, and front resistance members may have a similar configuration to the resistance member 284 illustrated in FIG. 16.

It should further be understood that the exercise device 20 illustrated in FIG. 16 may include multiple top resistance members 284 similarly configured to that illustrated in FIG. 16 and such multiple resistance members 284 may provide varying levels of resistance and be interchangeably connected to the connecting members 272 to provide varying levels of resistance to the user during exercise.

With continued reference to FIG. 16, to couple the top resistance member 284 to the connecting members 272, a user stretches the resistance member 284 wider than the distance between the connecting members 272, aligns the interior opening of the top resistance member 284 with the connecting members 272, moves the top resistance member 284 downward around the connecting members 272, and releases the top resistance member 284. At this point, the top resistance member 284 assumes the shape illustrated in FIG. 16. The top resistance member 284 is under tension and may be used in a variety of different manners to exercise a user's lower leg. To remove the top resistance member 284, a user grasps the top resistance member 284, pulls the ends of the top resistance member 284 outwardly away from the connection members 272 and out from under the enlarged portions 280 of the connecting members 272, and moves the top resistance member 284 upward away from the connecting members 272.

Figure 17:
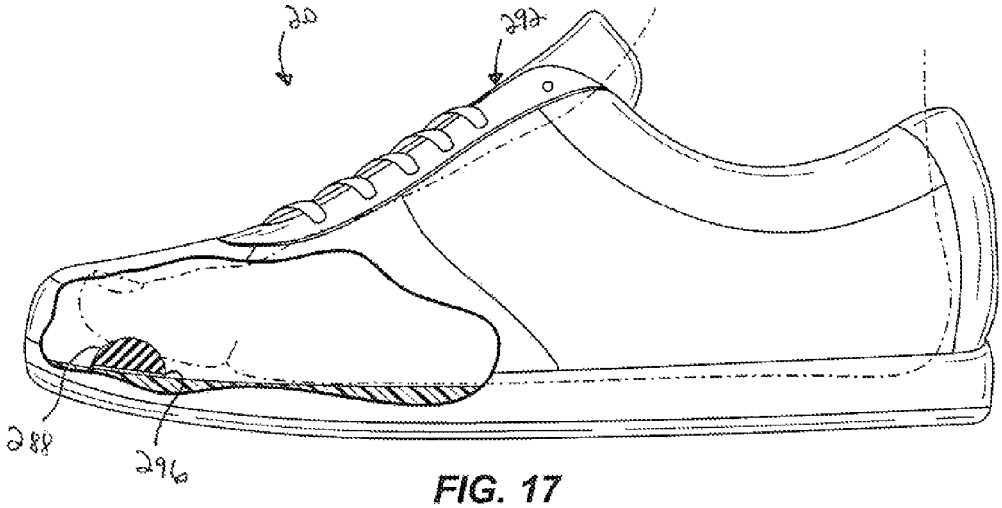
FIG. 17 is a cross-sectional view, taken along a vertical plane, of still a further exemplary embodiment of an exercise device, the exercise device is a shoe.

Referring now to FIG. 17, yet a further alternative exemplary embodiment of an exercise device 20 is illustrated. Similar components between the exemplary exercise device 20 illustrated in FIG. 17 and other exemplary exercise devices 20 illustrated in other figures of the present application may be identified with the same reference numbers.

In this illustrated exemplary embodiment, a resistance member 288 is coupled to an interior of footwear 292 such as, for example, a shoe 292. The resistance member 288 is coupled to the interior of the shoe 292 near a front thereof where a user may engage the resistance member 288 with his/her toes. A user may depress, push, pull, or perform any other action against the resistance member 288 to exercise the user's toes. Additionally, the exercise device 20 illustrated in FIG. 17 may include a plurality of interchangeable resistance members 288 that may be interchangeably connected to the interior of the shoe 292 via a connecting member 296. The plurality of resistance members 288 may have varying levels of resistance to provide the user with varying levels of resistance during exercise. The connecting member 296 may be a variety of different connecting members such as, for example, a hook and loop type fastener, snaps, adhesive, etc. Alternatively, the resistance member 288 may be permanently connected to the interior of the shoe 292.

Figure 18:
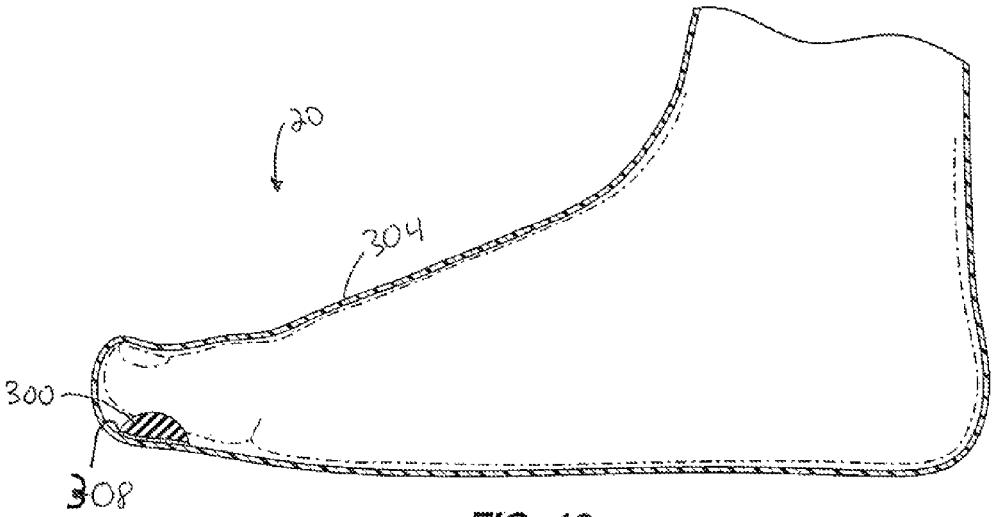
FIG. 18 is a cross-sectional view, taken along a vertical plane, of another exemplary embodiment of an exercise device, the exercise device is a sock.

Referring now to FIG. 18, yet a further alternative exemplary embodiment of an exercise device 20 is illustrated. Similar components between the exemplary exercise device 20 illustrated in FIG. 18 and other exemplary exercise devices 20 illustrated in other figures of the present application may be identified with the same reference numbers.

In this illustrated exemplary embodiment, a resistance member 300 is coupled to an interior of footwear 304 such as, for example, a sock 304. The resistance member 300 is coupled to the interior of the sock 304 near a front thereof where a user may engage the resistance member 300 with his/her toes. A user may depress, push, pull, or perform any other action against the resistance member 300 to exercise the user's toes. Additionally, the exercise device 20 illustrated in FIG. 18 may include a plurality of interchangeable resistance members 300 that may be interchangeably connected to the interior of the sock 304 via a connecting member 308. The plurality of resistance members 300 may have varying levels of resistance to provide the user with varying levels of resistance during exercise. The connecting member 308 may be a variety of different connecting members such as, for example, a hook and loop type fastener, snaps, adhesive, etc. Alternatively, the resistance member 300 may be permanently connected to the interior of the sock 304.

Figure 19:
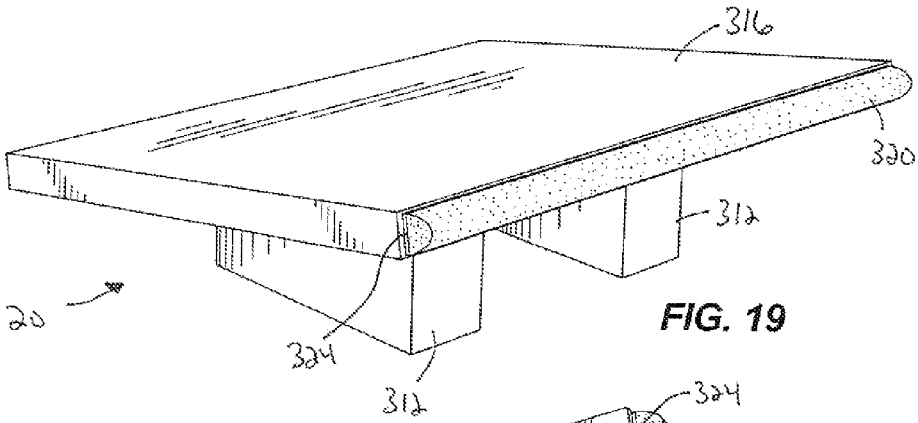
FIG. 19 is a top front perspective view of yet another exemplary embodiment of an exercise device.
Figure 20:
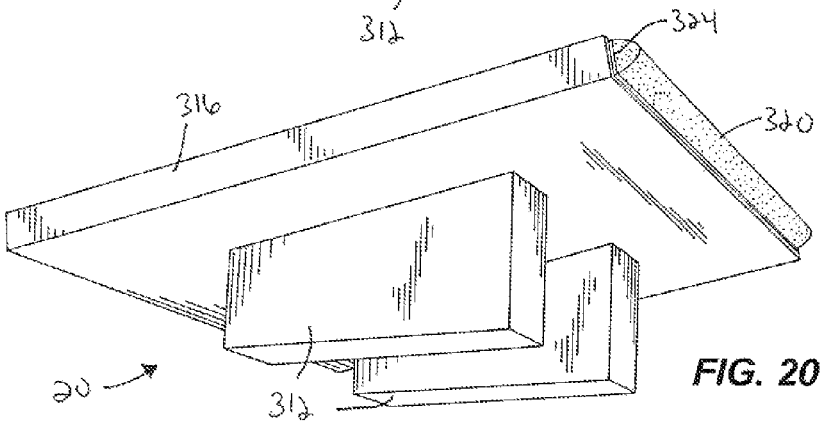
FIG. 20 is a bottom front perspective view of the exercise device shown in FIG. 19.

Referring now to FIGS. 19 and 20, still a further alternative exemplary embodiment of an exercise device 20 is illustrated. Similar components between the exemplary exercise device 20 illustrated in FIGS. 19 and 20 and other exemplary exercise devices 20 illustrated in other figures of the present application may be identified with the same reference numbers.

The illustrated exemplary embodiment of the exercise device 20 illustrated in FIGS. 19 and 20 includes a pair of base members 312 and a platform 316 coupled to a top of the base members 312. The base members 312 engage and rest upon a floor surface or ground and support the platform 316 in an inclined orientation. The platform 316 is adapted to support a user's foot during exercise of the user's foot. A resistance member 320 is coupled to a front wall of the platform 316 and is engageable by a user's toes by wrapping toes over a front edge of the platform 316. The exercise device 20 may include a plurality of resistance members 320 having varying levels of resistance and such resistance members may be interchangeably coupled to the front wall of the platform 316 via a connecting member 324. The connecting member 324 may be a wide variety of connecting members such as, for example, a hook and loop type fastener, snaps, adhesive, or any other type of connecting member.

It should be understood that the exercise device 20 illustrated in FIGS. 19 and 20 may have the resistance member 320 coupled to a top wall of the platform 316 rather than a front wall of the platform 316. In such a configuration, the resistance member 320 includes all the capabilities of the resistance member 320 coupled to the front wall of the platform 316 as described above.

Referring now to FIG. 21, another alternative exemplary embodiment of an exercise device 20 is illustrated. Similar components between the exemplary exercise device 20 illustrated in FIG. 21 and other exemplary exercise devices 20 illustrated in other figures of the present application may be identified with the same reference numbers.

The exemplary exercise device 20 illustrated in FIG. 21 includes an adjustable heel support 328 that is adjustable to receive and support feet of all sizes. In the illustrated exemplary embodiment, the adjustable heel support 328 is arcuate in shape, includes a comfort pad 332 made of a soft material, and is positioned on and movable along the top wall 48 of the exercise device 20. The adjustable heel support 328 may be removably secured in place in a variety of different manners. In the illustrated exemplary embodiment, the exercise device 20 includes a pair of support members 336, one on each side of the heel support 328, and a plurality of engagement members 340 defined in the support members 336 for selectively engaging projections 344 extending from ends of the adjustable heel support 328 (one projection 344 on each end). The engagement members 340 may take any shape, however, in the illustrated exemplary embodiment, the engagement members 340 are spaced apart from each other and include a general saw-tooth type pattern. Each engagement member 340 includes a notch 348 for receiving one of the projections 344 of the heel support 328. A user may move the adjustable heel support 328 to a desired position and secure it in place by positioning the projections 344 in notches 348 of engagement members 340 associated with the desired position. Once the adjustable heel support 328 is secured in place, the user may use the exercise device 20 without worry about movement of the adjustable heel support 328.

It should be understood that the illustrated exemplary embodiment of the adjustable heel support 328 is not intended to be limiting. Rather, the adjustable heel support 328 may have other shapes and configurations, and may be removably secured to the housing 24 in a variety of different manners and locations and still be within the intended spirit and scope of the present invention.

As can be seen from the above description, the various exercise devices 20 may have a variety of different operations and exercises. With reference to FIG. 22, it may be helpful for users of the exercise devices 20 to have information 352 located on the exercise devices 20. Such information could assist the users with assembly and disassembly of the exercise devices 20, could include instructions describing and/or showing users all the possible exercises and the proper manner of performing the exercises, or could include any other information that may be helpful to the users. The information 352 may be located anywhere on the exercises devices 20. In some embodiments, the information 352 may be located on a bottom wall 44 of the exercise device 20.

With continued reference to FIG. 22, the exercise devices 20 disclosed herein may also include an erasable writing surface 356 thereon for a user to write information 352 and later erase such information 352. For example, a user may desire to keep track of his/her exercise routine and/or performance. A user could write such information 352 on the erasable writing surface 356 located on the exercises devices 20 disclosed herein. The erasable writing surface 356 may be located anywhere on the exercises devices 20. In some embodiments, the erasable writing surface 356 may be located on a bottom wall 44 of the exercise device 20.

It should also be understood that the structures, functions, and concepts of the exemplary exercise devices 20 described above and illustrated in FIGS. 1-22 may be combined with each other in any manner. For example, structures, functions, and concepts of the exercise device 20 illustrated in FIGS. 1-3 may be combined with the exercise device 20 illustrated in FIGS. 7 and 8, and vice versa. Many other combinations of structures, functions, and concepts disclosed herein are possible and are intended to be within the spirit and scope of the present invention.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. An exercise device for a foot, the exercise device comprising:

a housing including a top wall and a side wall generally perpendicular to the top wall;

a top connecting member coupled to the top wall;

a first resilient resistance member engageable with the top connecting member to removably couple the first resilient resistance member to the top wall, wherein the first resilient resistance member is adapted to be engaged by the foot;

a second resilient resistance member engageable with the top connecting member to removably couple the second resilient resistance member to the top wall, wherein the second resilient resistance member is adapted to be engaged by the foot, and wherein only one of the first resilient resistance member and second resilient resistance member engages the top connecting member at a time to removably couple only one of the first resilient resistance member and second resilient resistance member to the top wall at a time;

a side connecting member coupled to the side wall;

a third resilient resistance member engageable with the side connecting member to removably couple the third resilient resistance member to the side wall, wherein the third resilient resistance member is adapted to be engaged by the foot; and a fourth resilient resistance member engageable with the side connecting member to removably couple the fourth resilient resistance member to the side wall, wherein the fourth resilient resistance member is adapted to be engaged by the foot, and wherein only one of the third resilient resistance member and fourth resilient resistance member engages the side connecting member at a time to removably couple only one of the third resilient resistance member and fourth resilient resistance member to the top wall at a time.

2. The exercise device of claim 1, wherein the top wall includes an angled portion and a horizontal portion and the top connecting member is coupled to the horizontal portion.

3. The exercise device of claim 1, wherein the top connecting member is a hook and loop type fastener.

4. The exercise device of claim 1, wherein the first and second resilient resistance members have an arcuate shape.

5. The exercise device of claim 1, further comprising a first recess defined in the top wall and a second recess defined in the side wall, wherein the top connecting member is at least partially positioned within the first recess and the side connecting member is at least partially positioned within the second recess, and wherein, when one of the first and second resilient resistance members is coupled to the top connecting member, the one of the first and second resilient resistance members is at least partially positioned within the first recess, and wherein, when one of the third and fourth resilient resistance members is coupled to the side connecting member, the one of the third and fourth resilient resistance members is at least partially positioned within the second recess.

6. The exercise device of claim 1, wherein the housing defines a cavity therein and the cavity includes an opening leading into the cavity, the exercise device further comprising a door coupled to the housing and movable between an open position, in which the door does not cover the opening of the cavity, and a closed position, in which the door covers the opening of the cavity.

7. The exercise device of claim 1, wherein the top connecting member is a first top connecting member and the side connecting member is a first side connecting member, the exercise device further comprising a second top connecting member and a second side connecting member, wherein the second top connecting member is spaced apart from the first top connecting member, and wherein the second side connecting member is spaced apart from the first side connecting member, and wherein the first and second resilient resistance members are engageable with and extend between the first and second top connecting members to removably couple one of the first and second resilient resistance members to the top wall at a time, and wherein the third and fourth resilient resistance members are engageable with and extend between the first and second side connecting members to removably couple one of the third and fourth resilient resistance members to the side wall at a time.

8. The exercise device of claim 7, wherein each of the first, second, third, and fourth resilient resistance members include an enlarged portion near both ends thereof, and wherein each of the enlarged portions of the first and second resilient resistance members are engageable with one of the first and second top connecting members, and wherein each of the enlarged portions of the third and fourth resilient resistance members are engageable with one of the first and second side connecting members.

9. The exercise device of claim 7, wherein the first and second resilient resistance members may be removably coupled to the first and second top connecting members in a plurality of orientations.

10. The exercise device of claim 1, further comprising an arch massage member coupled to the top wall and adapted to be engaged by the foot.

* * * * *